US007917063B2

(12) United States Patent
Horita et al.

(10) Patent No.: US 7,917,063 B2
(45) Date of Patent: Mar. 29, 2011

(54) CHARGING APPARATUS AND IMAGE FORMING APPARATUS

(75) Inventors: Shingo Horita, Numazu (JP); Ryo Nakamura, Mishima (JP); Koichi Hashimoto, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 572 days.

(21) Appl. No.: 11/837,829

(22) Filed: Aug. 13, 2007

(65) Prior Publication Data

US 2008/0050150 A1 Feb. 28, 2008

(30) Foreign Application Priority Data

Aug. 24, 2006 (JP) ..... 2006-227657
Aug. 3, 2007 (JP) ..... 2007-203240

(51) Int. Cl.
*G03G 15/02* (2006.01)

(52) U.S. Cl. ..... 399/175; 399/115

(58) Field of Classification Search ..... 399/115, 399/168, 174, 175, 176
See application file for complete search history.

(56) References Cited

U.S. PATENT DOCUMENTS 5,381,215 A * 1/1995 Haneda et al. ..... 399/174
5,940,662 A * 8/1999 Hano et al. ..... 399/175
6,052,545 A 4/2000 Komiya et al.
6,061,539 A 5/2000 Ishiyama et al.
6,064,837 A 5/2000 Hashimoto et al.
6,064,844 A 5/2000 Isobe et al.
6,215,967 B1 4/2001 Takeda et al.
6,219,509 B1 4/2001 Komiya et al.
6,229,979 B1 5/2001 Ishii et al.
6,301,455 B1 10/2001 Ishiyama et al.
6,301,459 B1 10/2001 Ishiyama et al.
6,393,238 B1 5/2002 Hashimoto et al.
6,654,583 B2 11/2003 Suzuki et al.
7,103,303 B2 9/2006 Suzuki et al.
7,130,565 B2 10/2006 Nakamura et al.

FOREIGN PATENT DOCUMENTS

JP 8-106201 A 4/1996
JP 2006-163296 A 6/2006

* cited by examiner

*Primary Examiner* — David P Porta
*Assistant Examiner* — Benjamin Schmitt
(74) *Attorney, Agent, or Firm* — Fitzpatrick, Cella, Harper & Scinto

(57) ABSTRACT

A charging apparatus for charging a member to be charged by contacting magnetic particles to the member to be charged, includes a magnetic particle carrying member for magnetically carrying the magnetic particles, wherein the magnetic particle carrying member is provided at a longitudinal end portion of the magnetic particle carrying member with an insulative portion for electrically insulating from the magnetic particles carried by the magnetic particle carrying member; and an electroconductive member disposed for contacting the magnetic particles carried on the insulative portion, wherein an absolute value of a potential of the electroconductive member is lower than an absolute value of a voltage applied to the magnetic particle carrying member.

20 Claims, 13 Drawing Sheets

CHARGING APPARATUS AND IMAGE FORMING APPARATUS

FIELD OF THE INVENTION AND RELATED ART

The present invention relates to a charging apparatus mounted in an image forming apparatus, such as an electrophotographic copying machine. It also relates to an image forming apparatus having a charging apparatus.

An image forming apparatus, such as an electrophotographic copying machine, an electrophotographic printer, etc., employs a charging apparatus for charging a peripheral surface (circumferential surface) of a photosensitive drum as an image bearing member. As one of the changing apparatuses for charging a photosensitive drum, a charging apparatus having a charge roller or a magnetic brush has been known. This type of charging apparatus (which hereafter may be referred to simply as contact charging apparatus) charges the peripheral surface of a photosensitive drum by placing the charge roller or magnetic brush in contact with the peripheral surface. Among the contact charging apparatuses, a charging apparatus which uses a magnetic brush as a charging means has electrically-conductive magnetic particles, and a member by which the magnetic particles are borne in the form of a magnetic brush. The magnetic particle bearing member is in the form of a sleeve (which hereafter may be referred to as charging sleeve), and bears the magnetic particles on its peripheral surface. A charging apparatus which uses a magnetic brush charges the peripheral surface of a photosensitive drum by placing the magnetic particles in contact with the peripheral surface of the photosensitive drum.

One of the problems which a charging apparatus of the magnetic brush type is that the magnetic particles on the charging sleeve adhere to a photosensitive drum, and then, move from the photosensitive drum into a developing device, mixing with developer therein. As the magnetic particles mix into the developer, a problem that images of low quality are formed, and also, a problem that images fail to be satisfactorily transferred in a transferring portion. There is another problem. That is, the magnetic particles become stuck between a cleaning member and a photosensitive drum, sometimes damaging the peripheral surface of the photosensitive drum.

More specifically, it is from the lengthwise end portions of the magnetic particle bearing portion of the charging sleeve that the magnetic particles on the charging sleeve are likely to transfer onto the photosensitive drum, for the following reasons:

That is, the magnetic force of the magnet in the hollow of the charging sleeve is weak across the lengthwise end portions of the magnetic particle bearing portion of the charging sleeve. In other words, in terms of the lengthwise direction of the magnet, the magnetic force which keeps the magnetic particles held to the charging sleeve is weak across the ranges which correspond to lengthwise end portions of the charging sleeve, making it easier for the magnetic particles on the lengthwise end portions of the charging sleeve to transfer onto the photosensitive drum.

On the other hand, even if a small portion of the body of magnetic particles transfer on the peripheral surface of the charging sleeve move onto the photosensitive drum, the transferred magnetic particles are scooped up by the body of magnetic particles remaining on the charging sleeve, being thereby transferred back onto the charging sleeve, in the contact area between the photosensitive drum and magnetic brush, as long as the amount of magnetic particles remaining on the charging sleeve is large enough. However, the magnetic force from the magnet is weak across the lengthwise end portions of the magnetic particle bearing portion of the charging sleeve as described above. Therefore, the magnetic particles held on the lengthwise end portions of the magnetic particle bearing portion of the charging sleeve are unstable (in that they are unlikely to remain stably held to the charging sleeve). Thus, once the magnetic particles transfer from these portions of the charging sleeve onto the photosensitive drum, they are likely to remain on the photosensitive drum.

One of the causes of the adhesion of magnetic particles to a photosensitive drum is the electric charge which magnetic particles accumulate. As electric charge accumulates in magnetic particles, a mirror force is generated in a manner to cause the magnetic particles and photosensitive drum to attract each other. As one of the methods for preventing electric charge from accumulating in the magnetic particles on the end portions of the charging sleeve, there is the following technology:

The method disclosed in Japanese Laid-open Patent Application Hei 8-106201 is such a method that electrically insulates both of the lengthwise end portions of the peripheral surface of a charge sleeve, in order to make the lengthwise end portions unable to charge the photosensitive drum. That is, the objective of this method is to make as small as possible the difference in potential between the magnetic particles on the end portions of the charging sleeve, and the photosensitive drum, in order to prevent the magnetic particles from adhering to the photosensitive drum.

The method disclosed in Japanese Laid-open Patent Application 2006-163296 is such a method that electrically insulates both of the lengthwise end portions of a charge sleeve, in order to make the lengthwise end portions unable to charge the photosensitive drum, and also, that makes unchargeable both of the lengthwise end portions of the photosensitive drum, which correspond to the nonconductive portions of the charging sleeve. Further, the unchargeable portions of the photosensitive drum are grounded. That is, the objective of this method is to allow electric charge to escape from the magnetic particles on the nonconductive portions of the charging sleeve, in order to prevent the magnetic particles from adhering to the photosensitive drum.

However, charging apparatuses, such as those described above, which are in accordance with the prior art, suffer from the following problems.

In the case of the charging apparatus disclosed in Japanese Laid-open Patent Application Hei 8-106201, the magnetic particles on the nonconductive portions of the charging sleeve remain electrically insulated from the charging sleeve to which voltage is applied. Therefore, it does not occur that electric charge moves from the charging sleeve to the magnetic particles on the insulated portions of the charging sleeve. ("Insulated portion" and "insulated portions" are sometimes herein used interchangeably with "insulative portion" and "insulative portions", respectively.) However, electric charge moves to the magnetic particles on the portions of the uninsulated (conductive) portion of the charging sleeve. Thus, electric charge moves to the magnetic particles on the insulated portions of the charging sleeve, from the magnetic particles on the portions of the uninsulated portion of the charging sleeve, which are next to the insulated portions. That is, electric charge moves from the magnetic particles which directly receive electric charge from the charging sleeve, to the magnetic particles which do not directly receive electric charge from the charging sleeve. Therefore, even if the lengthwise end portions of the charging sleeves are insulated, the magnetic particles on the insulated portions of the charging sleeve become electrically charged. Further, a conventional charging apparatus is structured so that its conductive blade for regulating in thickness the magnetic particle layer on the charging sleeve opposes the charging sleeve. Thus, as a preset voltage is applied to the charging sleeve, electric charge flows into the regulating blade through the magnetic particles on the charging sleeve. As a result, the regulating blade is also charged to a potential level which is close to the level of the preset voltage applied to the charging sleeve. Then, electric charge moves from the regulating blade to the magnetic particles on the lengthwise end portions of the charging sleeve. Thus, even if the lengthwise end portions of the charging sleeve are electrically insulated, the magnetic particles on the lengthwise end portions of the charging sleeve are likely to adhere to the photosensitive drum.

In the case of the image forming apparatus disclosed in Patent Japanese Laid-open Patent Application 2006-163296, the lengthwise end portions of the photosensitive drum are rendered unchargeable, and are grounded. Thus, as electric charge flows into the magnetic particles on the unchargeable portions of the photosensitive drum, it moves from the magnetic particles to the unchargeable portions, and then, escapes out of the charging device. Therefore, the magnetic particles which are in contact with the unchargeable portions of the photosensitive drum are likely to collect electric charge, being therefore likely to induce a mirror force in the unchargeable portions. Therefore, the magnetic particles on the unchargeable portions of the photosensitive drum are subjected to the electrical force which causes the magnetic particles to be attracted to the unchargeable portions of the photosensitive drum. Further, the unchargeable portions of the photosensitive drum rotate with the chargeable portion of the photosensitive drum. Therefore, the magnetic particles having adhered to the photosensitive drum are conveyed downstream, in terms of the rotational direction of the photosensitive drum, by the rotation of the photosensitive drum. Moreover, it is rather difficult to prevent the magnetic particles from being attracted to the photosensitive drum by the above-mentioned mirror force. Also in the case of the image forming apparatus disclosed in Patent Japanese Laid-open Patent Application 2006-163296, the portions of the photosensitive drum, which correspond to the insulated portions of the charging sleeve, are rendered unchargeable. However, processing the photosensitive drum to make the above-mentioned portions of the photosensitive drum unchargeable, after the formation of the photosensitive layer on the photosensitive drum, is not easy, and also, is costly. Further, if the photosensitive drum is processed as described, there will be a step between the portion of the peripheral surface of the photosensitive drum, which has the photosensitive layer, and the portions of the peripheral surface of the photosensitive drum, which are unchargeable.

The cleaner of an image forming apparatus has a plate-like member (which hereafter will be referred to as cleaning blade) molded of resin, which is attached to the main frame of the apparatus so that it is kept pressed on the peripheral surface of the photosensitive drum to remove the unwanted substances, such as the toner particles remaining on the photosensitive drum after image transfer. In the case of an image forming apparatus having a charging apparatus of the magnetic brush type, foreign substances, such as toner particles, enter the charging apparatus, the body of magnetic particles in the charging apparatus increase in electrical resistance, reducing therefore the charging apparatus in charging performance. Therefore, in the case of an image forming apparatus having a charging apparatus of the magnetic brush type, in order to prevent the foreign substances, such as toner particles, from entering the charging apparatus, the cleaning blade of the image forming apparatus is kept pressed upon the peripheral surface of the photosensitive drum across the entire range which corresponds to magnetic particle bearing portion of the charging sleeve.

In the case of a photosensitive drum processed as described above, the cleaning blade is kept pressed upon the photosensitive drum across the entire range which includes the steps between the chargeable portion and unchargeable portions. If the cleaning blade is kept pressed for a long time, upon the portion of the photosensitive drum, which has the steps, the portions of the cleaning blade, which correspond to the steps are deteriorated or mechanically damaged. The deteriorated or damaged portions of the cleaning blade cannot remove the toner particles and foreign substances on the photosensitive drum. Therefore, the toner particles and foreign substances slip by the cleaning blade and enter the charging apparatus, reducing therefore the charging apparatus in charging performance.

SUMMARY OF THE INVENTION

The present invention is the result of further development of the prior technologies described above. The primary object of the present invention is to prevent electric charge from accumulating in the magnetic particles on the lengthwise end portions of a magnetic particle bearing member. Another object of the present invention is to provide a charging apparatus whose magnetic particle bearing member prevents electric charge from accumulating in the magnetic particles on the lengthwise end portions of the magnetic particle bearing member, and which is therefore significantly smaller in the amount by which magnetic particles adhere to the object which is to be charged by the charging apparatus, than a conventional charging apparatus. Another object of the present invention is to provide an image forming apparatus equipped with the above-described charging apparatus.

According to an aspect of the present invention, there is provided a charging apparatus for charging a member to be charged by contacting magnetic particles to the member to be charged, said charging apparatus comprising a magnetic particle carrying member for magnetically carrying the magnetic particles, wherein said magnetic particle carrying member is provided at a longitudinal end portion of said magnetic particle carrying member with an insulated portion electrically insulating the magnetic particles carried by said magnetic particle carrying member; and an electroconductive member disposed for contacting the magnetic particles carried on said insulated portion, wherein an absolute value of a potential of said electroconductive member is lower than an absolute value of a voltage applied to said magnetic particle carrying member.

According to another aspect of the present invention, there is provided a charging apparatus for charging a member to be charged by contacting magnetic particles to the member to be charged, said charging apparatus comprising a magnetic particle carrying member for magnetically carrying the magnetic particles; a magnetic particle regulating member for regulating an amount of the magnetic particles carried on said magnetic particle carrying member, wherein said magnetic particle carrying member is provided at a longitudinal end portion of said magnetic particle carrying member with a first insulated portion electrically insulating the magnetic particles carried by said magnetic particle carrying member, and wherein said magnetic particle regulating member is provided at a portion opposing at least said first insulated portion with a second insulated portion for electrically insulating from the magnetic particles.

The present invention can reduce the amount by which the magnetic particles on the insulated lengthwise end portions of a magnetic particle bearing member are adhered to the lengthwise end portions of an object to be charged, such as an image bearing member.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the present invention will be described in detail with reference to the appended drawings.

Embodiment 1

(1) Example of Image Forming Apparatus

Figure 8:
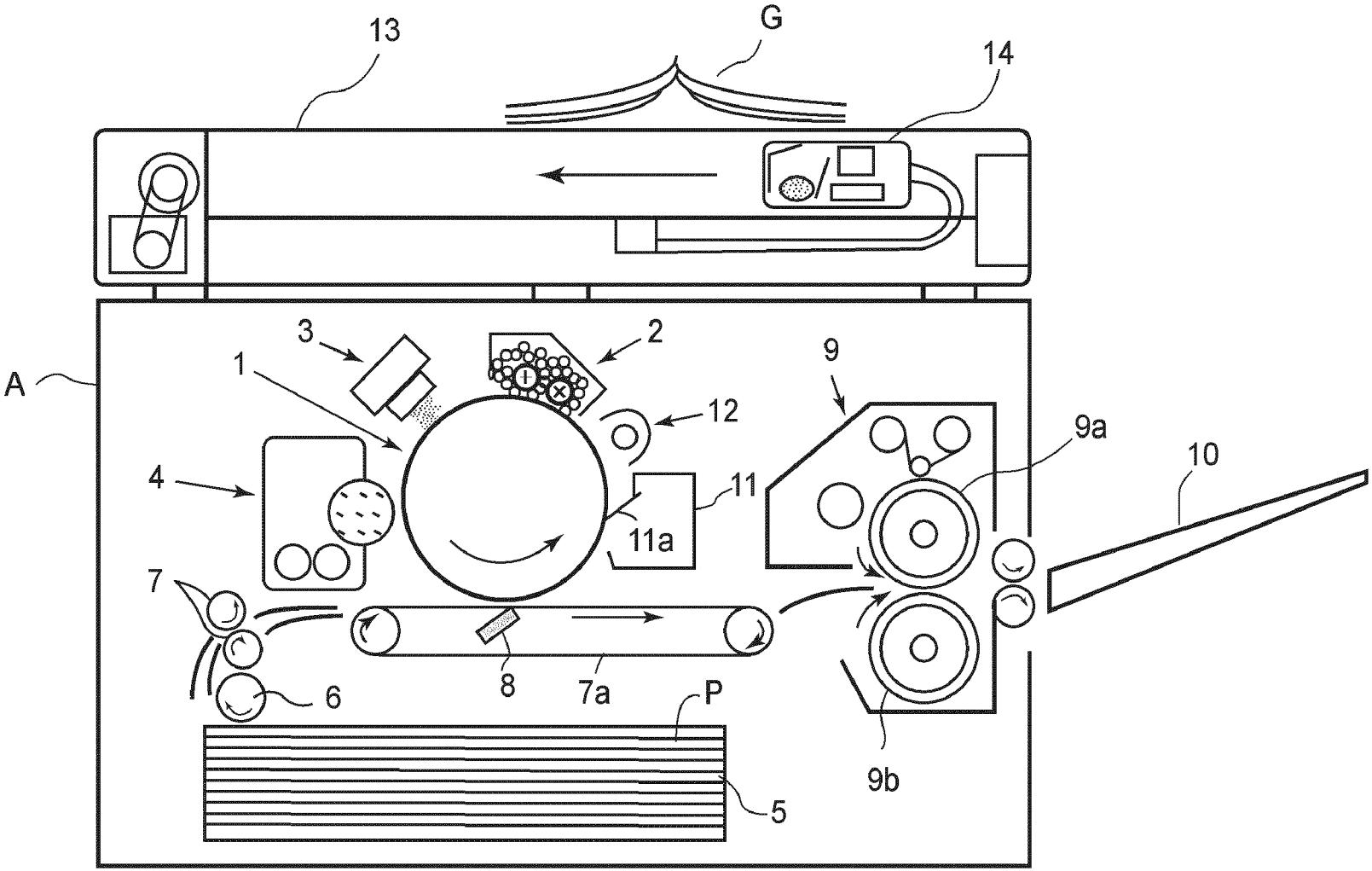
FIG. 8 is a vertical, sectional view of a typical image forming apparatus in accordance with the present invention.

FIG. 8 is a schematic drawing of an example of an image forming apparatus in which a charging apparatus in accordance with the present invention is mountable, and shows the structure of the image forming apparatus. This image forming apparatus is an electrophotographic copying machine.

In the following description of the preferred embodiments of the present invention, the "lengthwise direction" of the image forming apparatus and its structural components means the direction perpendicular to the direction in which recording medium is conveyed in the main assembly of the image forming apparatus. It is parallel to the axial line of the image bearing member, that is, a member to be charged. The "widthwise direction" of the image forming apparatus and its structural components is the direction parallel to the above-mentioned recording medium conveyance direction.

The main assembly of the image forming apparatus in this embodiment has a photosensitive drum 1, which is an image bearing member in the form of a drum. The photosensitive drum 1 is the member to be charged by the charging means of the image forming apparatus. The photosensitive drum 1 is supported by the housing (which also serves as primary apparatus frame). As the photosensitive material for the photosensitive layer of the photosensitive drum 1, positively chargeable amorphous silicon is used. The photosensitive drum 1, that is, a positively chargeable photosensitive member whose photosensitive layer is formed of amorphous silicon., is made up of: a cylinder (electrically-conductive supporting member) and three functional layers, that is, a negative charge transfer prevention layer, a photosensitive layer, and a surface protection layer, which were layered on the peripheral surface of the cylinder, in the listed order. The cylinder is formed of aluminum, and is 84 mm in external diameter.

As a copy start signal (print signal) is inputted into the image forming apparatus in this embodiment, the photosensitive drum 1 rotates in the direction indicated by an arrow mark, while being uniformly charged across its peripheral surface, in terms of its lengthwise direction, by a charging apparatus 2 to preset polarity and potential level.

Meanwhile, an original G on an original placement platen 13 is scanned with a beam of light emitted by a scanning unit 14 made up of an original illuminating lamp, a short focal point lens array, and a CCD sensor. As the original G is scanned, the portion of the scanning beam of light, which is reflected by the surface of the original G is focused on the CCD sensor by the lens array. The lens array has a light receiving portion, a transfer portion, an output portion, etc. As the reflected beam of light (optical signals) is focused on the CCD sensor, it is converted by the light receiving portion of the CCD sensor into signals in the form of electric charge, which are sequentially transferred to the output portion by the transfer portion in synchronism with clock pulses. Then, the signals in the form of electric charge are converted into signals in the form of voltage, in the signal output portion. Then, the signals in the form of voltage are amplified, are reduced in impedance, and are outputted in the form of analog signals. The thus obtained analog signals are put through a preset image processing operation, being thereby converted into digital signals (picture signals), and then, are transferred to the printing portion (image forming portion). The printing portion forms, on the peripheral surface of the photosensitive drum 1, an electrostatic latent image which reflects the original, with the use of an exposing means 3 made up of LEDs, which are turned on (emit light) or off in response to the picture signals from the signal outputting portion.

After the formation of the electrostatic latent image on the peripheral surface of the photosensitive drum 1, the latent image is developed into a visible image, that is, an image formed of toner (developer), by a developing device 4 (developing means) which uses toner (developer). Meanwhile, a transfer medium P, that is, a recording medium, is conveyed from a sheet feeder cassette 5 to a transferring apparatus 8 (transferring means), by a sheet conveyance roller 6 and a pair of pickup rollers 7, in synchronism with the arrival of the image formed of toner (which hereafter will be referred to as a "toner image") at the transferring apparatus 8. Then, the toner image is electrostatically transferred onto the transfer medium P by the transferring apparatus 8. Then, the transfer medium P is electrostatically separated from the peripheral surface of the photosensitive drum 1, and is conveyed to a fixing apparatus 9, which is made up of a fixation roller 9*a* and a pressure roller 9*b*, which are heated by their own heat sources. In the fixing apparatus 9, the transfer medium P is conveyed through the fixation nip, that is, the nip between the fixation roller 9*a* and pressure roller 9*b*, while remaining pinched by the two rollers 9*a* and 9*b*. While the transfer medium P is conveyed through the fixation nip, heat and pressure are applied to the transfer medium P and the unfixed toner image thereon, by the combination of the heated fixation roller 9*a* and heated pressure roller 9*b*. As a result, the unfixed toner image on the transfer medium P is thermally fixed to the transfer medium P. After the thermal fixation of the unfixed toner image to the transfer medium P, the transfer medium P is discharged into an external delivery tray 10 attached to the main assembly A of the image forming apparatus.

After the transfer of the unfixed toner image from the photosensitive drum 1, a cleaning member 11*a*, with which a cleaning means 11 is provided, comes into contact with the portion of the peripheral surface of the photosensitive drum 1, on which the toner image was present before its transfer. As a result, the contaminants, such as the toner particles remaining on the peripheral surface of the photosensitive drum 1 after the transfer, are removed by the cleaning member 11*a*. Then, the cleaned portion of the peripheral surface of the photosensitive drum 1 is exposed by a pre-exposing means 12 to rid the photosensitive drum 1 of the optical memory attributable to the exposing process to which the portion of the peripheral surface of the photosensitive drum 1 put through during the immediately preceding rotation of the photosensitive drum 1. Thus, the peripheral surface of the photosensitive drum 1 is repeatedly usable for image formation.

(2) Charging Apparatus

The charging apparatus 2 in this embodiment is a charging apparatus of the magnetic brush type. It is made up of: a charging sleeve; a magnet disposed in the hollow of the charge sleeve; and electrically-conductive magnetic particles held on the peripheral surface (circumferential surface) of the charging sleeve. It charges the peripheral surface of the photosensitive drum 1 by placing the magnetic particles in contact with the peripheral surface of the photosensitive drum 1.

Figure 1:
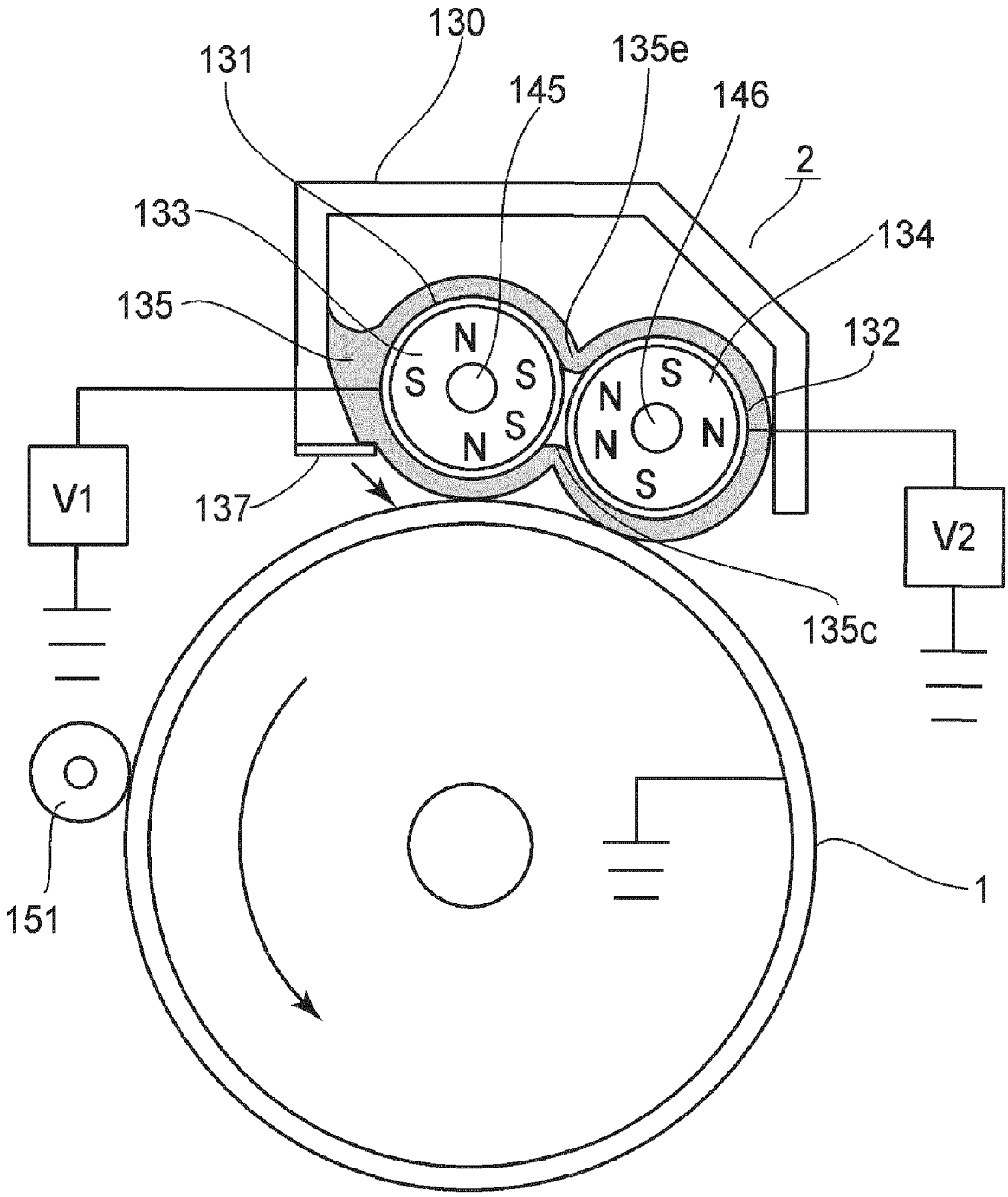
FIG. 1 is a vertical sectional view of the charging apparatus in the first to seventh embodiments of the present invention, showing the structural arrangement of the charging apparatus, which is for measuring the amount of the magnetic particles having adhered to the lengthwise end portions of the photosensitive drum.
Figure 2:
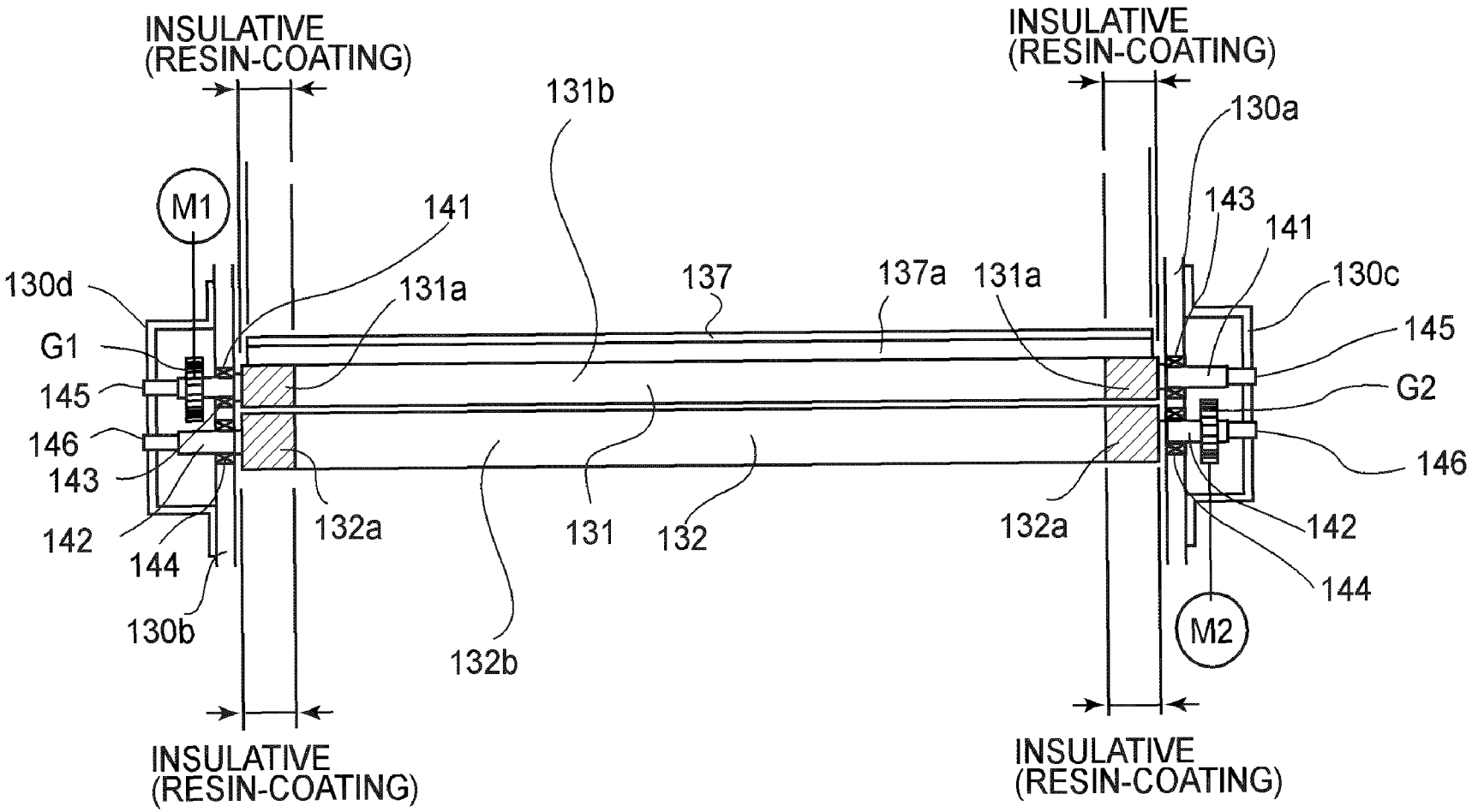
FIG. 2 is a plan view of the charging apparatus in the first to fourth embodiments of the present invention, showing the relationship among the first charging sleeve, second charging sleeve, and regulating blade of the charging apparatus.
Figure 3:
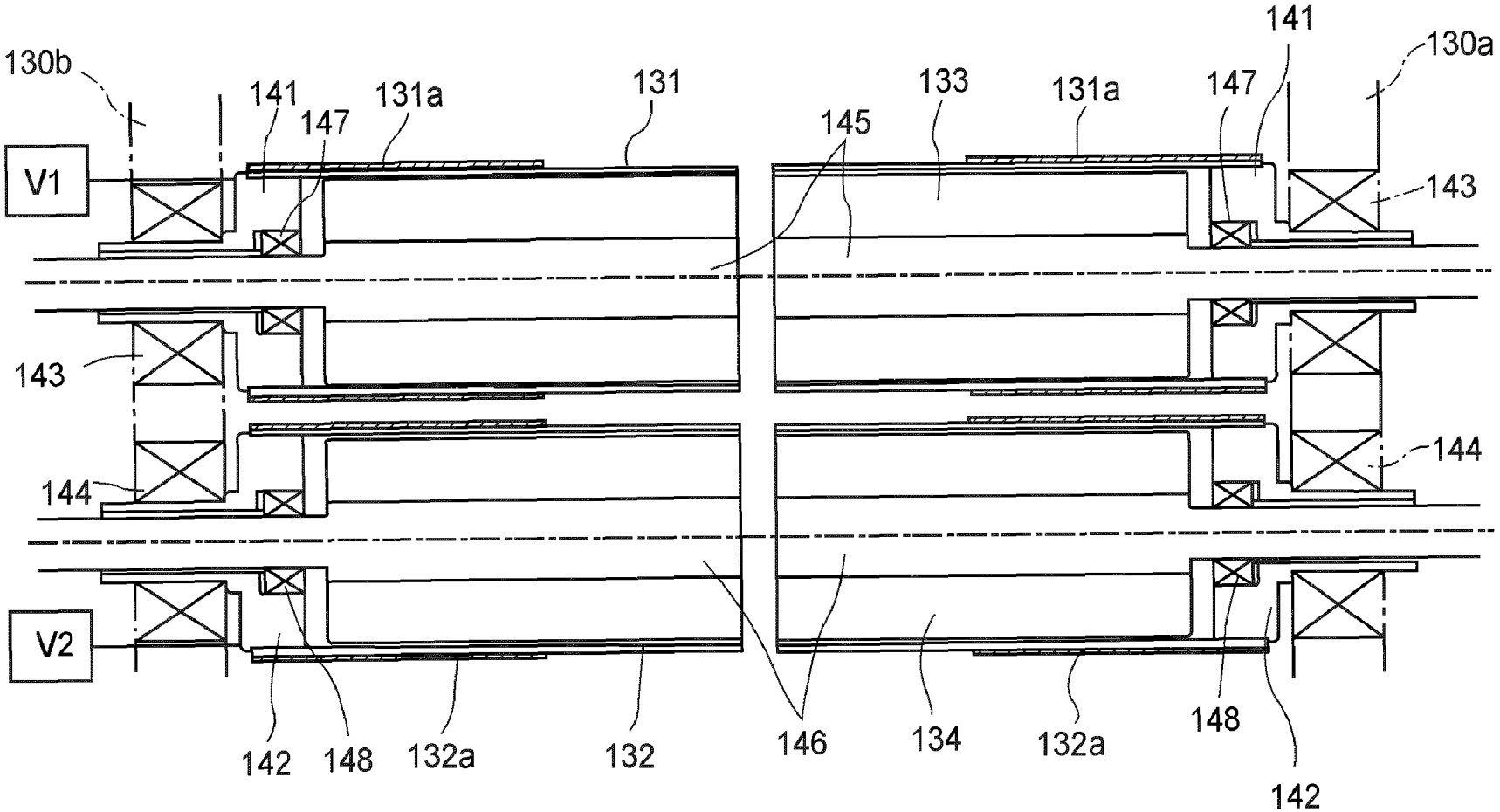
FIG. 3 is a schematic, sectional view of the charging apparatus, at the plane coinciding with the axial lines of the first and second charging sleeves, showing the structural arrangement for supporting the two charging sleeves.

FIG. 1 is a vertical, sectional view of the charging apparatus 2 and photosensitive drum 1, and shows the relationship between the two. FIG. 2 is a plan view of the charging apparatus 2, and shows the relationship among the first charging sleeve 131, second charging sleeve 132, and regulating blade 137 of the charging apparatus. FIG. 3 is a schematic, sectional view of the first and second charging sleeves 131 and 132, and the members which support the two charging sleeves 131 and 132 (their center portions, in terms of their lengthwise direction, are not shown), and shows the structural arrangement for supporting the two sleeves 131 and 132.

The charging apparatus 2 in this embodiment has: a charging means housing 130 (container), which also functions as the primary frame for supporting the charging means; two stationary magnets 133 and 134 as magnetic field generating means; and first and second charging sleeves 131 and 132, as magnetic particle bearing members, which are cylindrical and electrically conductive. The photosensitive drum 1 rotates in the direction indicated by an arrow mark. Hereafter, of the two charging sleeves, the charging sleeve 131, which is on the downstream side in terms of the rotational direction of the photosensitive drum 1, will be referred to as the first charging sleeve. The charging sleeves 131 and 132 rotate in the direction indicated by an arrow mark. Thus, in the area in which their peripheral surfaces oppose the peripheral surface of the photosensitive drum 1, the peripheral surfaces of the charging sleeves 131 and 132 move in the opposite direction from the moving direction of the peripheral surface of the photosensitive drum 1. Further, the charging apparatus 2 has: electrically-conductive magnetic particles 135, and a regulating blade 137 for regulating in thickness the magnetic particle layer. These members are long and narrow members which extend in the direction parallel to the lengthwise direction of the photosensitive drum 1.

The first charging sleeve 131 has a pair of sleeve flanges 141, which are attached to the lengthwise ends of the first charging sleeve 131, one for one. The second charging sleeve 131 has a pair of sleeve flanges 142, which are attached to the lengthwise ends of the second charging sleeve 132, one for one. The first charging sleeve 131 is rotatably supported by the lateral plates 130*a* and 130*b* of the charging means housing 130. More specifically, the first charging sleeve 131 is supported by the flange portions 141, with a pair of bearings 143 which are attached to the lateral plates 130*a* and 130*b*.

The magnets 133 and 134 are fitted in the charging sleeves 131 and 132, respectively, and are fitted around the metallic cores 145 and 146, respectively. Further, the magnet 133 is rotatably supported by the flanges 141, with the placement of a pair of bearings 147 between the lengthwise end portions of the magnets 133 and the flanges 141, one for one. The magnet 134 is rotatably supported by the flanges 142, with the placement of a pair of bearings 148 between the lengthwise end portions of the magnets 134 and the flanges 142, one for one. Further, the metallic cores 145 and 146 are solidly attached by their lengthwise end portions, to a pair of holding members 130*c* and 130*d* attached to the lateral plates 130*a* and 130*b*, respectively.

The magnets 133 and 134 are intricate in the positioning of their magnetic poles. Generally, if a magnet designed so that two magnetic poles which are the same in polarity are placed next to each other is placed in the charging sleeves 131 (132), the magnetic particles on the portion of the peripheral surface of the sleeve 131 (132) corresponding to the two magnetic poles tend to separate from the peripheral surface of the sleeve 131 (132). For the purpose of utilizing this tendency, the two magnets 133 and 134 are designed so that two magnetic poles which are the same in polarity are positioned at the top and bottom sides, and also, so that two of the three magnetic poles S of the magnet 133, which are next to each other, oppose two of the three magnetic poles N of the magnet 134, which are next to each other.

The magnetic particles 135 in the charging means housing 130 are magnetically held to the peripheral surface of the sleeve 131 and the peripheral surface of the sleeve 132, by the magnetic field (magnetic force). Thus, as the sleeves 131 and 132 rotate, the magnetic particles 135 on the peripheral surface of the sleeve 131 and the magnetic particles on the peripheral surface of the sleeve 132 transfer onto the peripheral surface of the sleeve 132 and the peripheral surface of the sleeve 131, respectively, without slipping through the gap between the two sleeves 131 and 132. That is, as the sleeves 131 and 132 rotate, the magnetic particles 135 on the peripheral surface of the sleeve 131 and the magnetic particles on the peripheral surface of the sleeve 132 are conveyed onto the peripheral surface of the sleeve 132 and the peripheral surface of the sleeve 131, respectively, by way of transfer bridge portions 135*c* and 135*e* between the sleeves 131 and 132.

The magnetic particles 135 are desired to be 10-100 μm in average particle diameter, 20-80 $A \cdot m^2/kg$ in saturation magnetization, and $10^2$-$10^{10}$ Ω·cm in electrical resistance. From the standpoint of enhancing the charging performance of the charging apparatus 2, the magnetic particles 135 are desired to be as small as possible in electrical resistance. However, in consideration of the fact that the photosensitive drum 1 may not be perfect as an electrical insulator (it may have pinholes or the like), the magnetic particles 135 are desired to be no less than $10^6$ Ω·cm in electrical resistance. The magnetic particles 135 used by the charging apparatus in this embodiment had been adjusted in electrical resistance by oxidizing or reducing the ferrite particle surface, and had been put through the coupling process. They were 25 μm in average particle diameter, 57 $A \cdot m^2/kg$ in saturation magnetization, and $5 \times 10^6$ Ω·cm in electrical resistance. The value of the above-mentioned electrical resistance of the magnetic particles 135 was obtained using the following method: 2 g of the magnetic particles for the charging apparatus were placed in a metallic cell, which is 2.28 $cm^2$ in bottom area, and is packed by applying a load of 65 Pa (6.6 $kg/cm^2$). Then, the electrical resistance was measured while applying 100 V of voltage.

The regulating blade 137 is positioned so that a preset amount of gap (sleeve blade gap, which hereafter will be referred to as S-B gap) is provided between the regulating edge of the regulating blade 137 and the peripheral surface of the first charging sleeve 131. The regulating blade 137 is supported by its lengthwise ends, by the lateral plates 130*a* and 130*b*, with the presence of unshown supporting members between the regulating blade 137 and lateral plates 130*a* and 130*b*. The regulating blade 137 regulates in thickness the layer of the magnetic particles 135 on the sleeve 131; as the body of magnetic particles 135 on the peripheral surface of the sleeve 131 is conveyed through the S-B gap by the rotation of the sleeve 131, it is formed into a uniform layer of magnetic particles 135, the thickness of which corresponds to the S-B gap. That is, not only does the regulating blade regulate the amount by which the magnetic particles 135 in the charging means housing are conveyed therefrom, per unit area of the peripheral surface of the first charging sleeve 131, toward the peripheral surface of the photosensitive drum 1 through the gap between the charging means housing and first charging sleeve 131, but also, it forms a uniform layer of the magnetic particles 135, which has a proper amount of magnetic particles per unit area of the peripheral surface of the charging sleeve 131. In this embodiment, the regulating blade 137 is formed of SUS, which is electrically conductive, and is floated in electrical terms.

The sleeves 131 and 132 are positioned so that a preset amount of gap is provided between the peripheral surface of the sleeve 131 and the peripheral surface of the photosensitive drum 1, and between the peripheral surface of the sleeve 132 and the peripheral surface of the photosensitive drum 1 (these gaps hereafter will be referred to as sleeve-drum gaps, S-D gaps). In terms of the circumferential direction of the magnets 133 and 134, the magnets 133 and 134 are positioned so that their magnetic poles cause the body of magnetic particles 135 on the peripheral surface of the sleeve 131 and the body of magnetic particles 135 on the peripheral surface of the sleeve 132 to crest where the distance between the peripheral surface of the sleeve 131 and the peripheral surface of the photosensitive drum 1 is smallest, and its adjacencies, and where the distance between the peripheral surface of the sleeve 131 and the peripheral surface of the photosensitive drum 1 is smallest, respectively. Positioning the magnets 133 and 134 as described above stabilizes the state of contact between the two bodies of magnetic particles 135 and the peripheral surface of the photosensitive drum 1.

(3) Structure of Lengthwise End Portions of Charging Sleeve

Referring to FIG. 2, the peripheral surface of the charging sleeve 131 (132) is made up Of electrically nonconductive portions 131*a* (132*a*) and an electrically-conductive portion 131*b* (132*b*). More specifically, both charging sleeves 131 and 132 are coated with resin across the lengthwise end portions of their peripheral surfaces. These resin-coated portions make up the insulated portions 131*a* and 132*a*, and the portion other than the resin-coated portions make up the conductive portions 131*b* and 132*b*. The resin coat is roughly 50 μm in thickness. The insulated portions 131*a* (132*a*), or the lengthwise end portions of the peripheral surface of the charging sleeve 131 (132), keep the magnetic particles 135 on these portions of the peripheral surface of the charging sleeve 131 (132) electrically insulated from the charging sleeve 131 (132).

Figure 4:
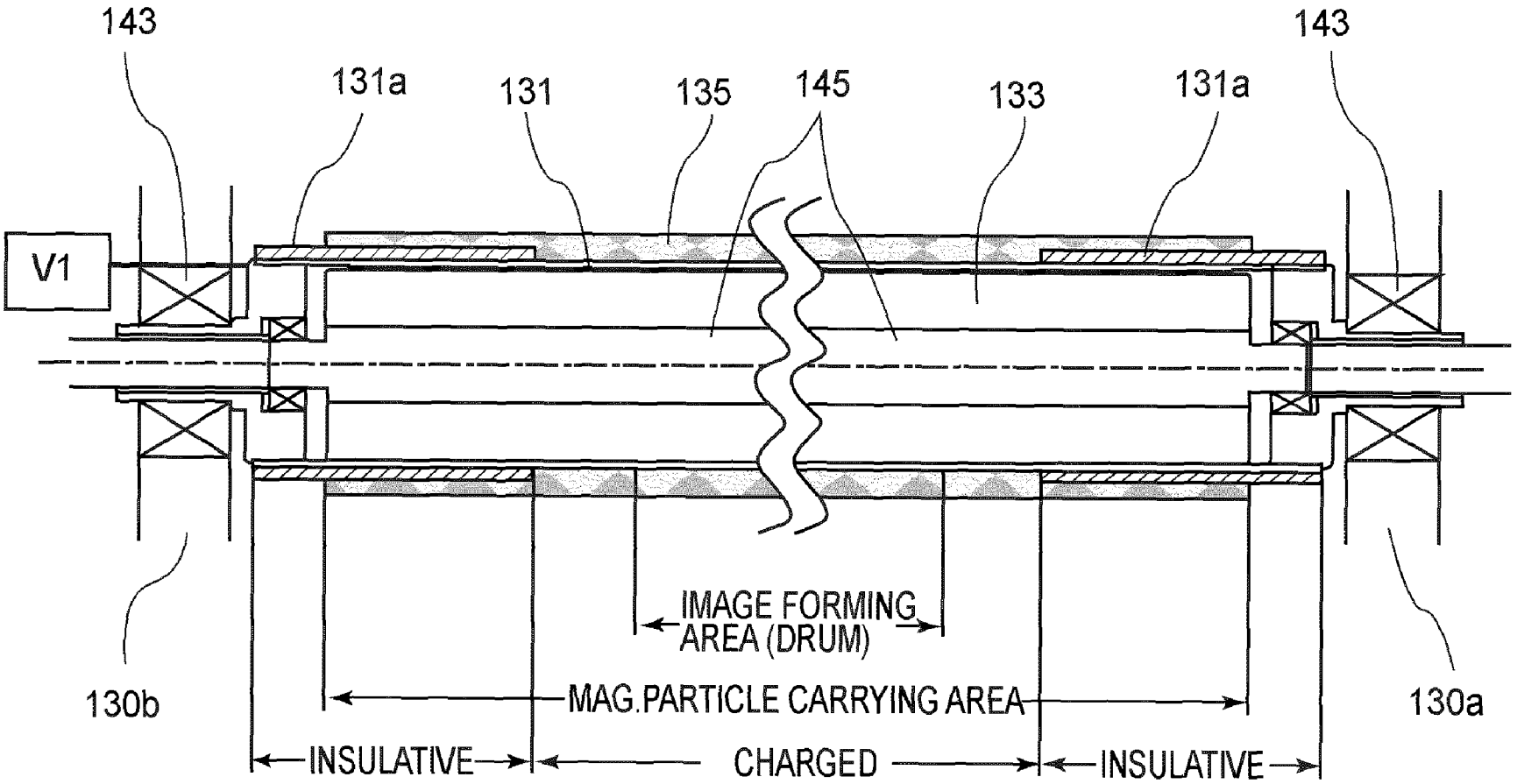
FIG. 4 is a schematic, sectional view of the first charging sleeve, at a plane coinciding with the axial line of the first charging sleeve, showing the relationship among the image forming range of the photosensitive drum, and the photosensitive drum charging range, electrically insulated ranges, and magnetic particle bearing range of the first charging sleeve, in terms of the lengthwise direction of the photosensitive drum and charging sleeve.

FIG. 4 shows the relationship, in terms of the lengthwise direction of the photosensitive drum and charging sleeves, among the image forming range of the photosensitive drum, photosensitive drum charging range of the charging sleeve, insulated ranges of the charging sleeve, and magnetic particle bearing range of the charging sleeve, regarding the first charging sleeve 131. Incidentally, the relationship among the image forming range of the photosensitive drum; photosensitive drum charging range of the charging sleeve; insulated ranges of the charging sleeve, and magnetic particle bearing range of the charging sleeve, regarding the second charging sleeve 132 is the same as that regarding the first charging sleeve 131, and therefore, will not be described here.

In terms of the lengthwise direction of the photosensitive drum 1, the image forming range of the photosensitive drum 1 is the portion of the peripheral surface of the photosensitive drum 1, across which a toner image is formed, which coincides with the portion of the peripheral surface of the peripheral surface of the photosensitive drum 1, across which a latent image is formed. The charging range of the charging sleeve is the range in which the magnetic particles on the charging sleeve actually charge the photosensitive drum. In other words, the charging range of the charging sleeve is the conductive portions 131*b*, that is, the portion of the charging sleeve 131 other than the insulated portions 131*a*, that is, the lengthwise end portions of the peripheral surface of the first charging sleeve 131. The image formation range of the photosensitive drum 1 is within the charging range of the charging sleeve 131. The magnetic particle bearing range of the charging sleeve 131 is the portion of the peripheral surface of the sleeve 131, across which the magnetic particles 135 are borne by the magnetic force of the magnet 133. The magnetic particle bearing range of the charging sleeve 131 is wide enough to include the charging range, and is roughly equal in length to the magnet 133. Further, each insulated portion 131*a* extends from the edge of the charging range to the corresponding lengthwise end of the charging sleeve 131 across the magnetic particle bearing range. That is, the insulated portion 131*a* extends outward from a point within the magnetic particle bearing range.

The magnetic particles 135 on the insulated portions 131*a* and 132*a* are insulated from the charging sleeves 131 and 132. Therefore, electric charge does not flow into the magnetic particles 135 on the insulated portions 131*a* and 132*a* of the charging sleeves 131 and 132, from the charging sleeves 131 and 132. That is, unlike the magnetic particles 135 in the charging range, the magnetic particles 135 on the insulated portions 131*a* and 132*a* do not directly receive electric charge from the sleeves 131 and 132. Therefore, the amount by which the magnetic particles 135 on the insulated portions 131*a* and 132*a* adhere to the lengthwise end portions of the photosensitive drum 1, which correspond to the insulated portions 131*a* and 132*a* is negligibly small. The reason therefor will be given later in Section (6): Measurement of Amount of Magnetic Particles Having Adhered to Lengthwise End Portions of Photosensitive Drum.

(4) Charging Process

The cylinder gears G1 and G2 (FIG. 2) of the flanges 141 and 142 of the charging apparatus 2 are rotationally driven by the motors M1 and M2, respectively, as driving means with which the main assembly of the image forming apparatus is provided. As the gears G1 and G2 are driven, the charging sleeves 131 and 132 rotate with the flanges 141 and 142, while bearing the magnetic particles 135 on their magnetic particle bearing ranges. As the charging sleeves 131 and 132 rotate, the body of magnetic particles on the peripheral surfaces of the charging sleeves 131 and 132 are regulated by the regulating blade 137. As the regulated portion of the body of magnetic particles 135 on the charging sleeves 131 and 132 reach the magnetic fields generated by the magnet 133, the body of magnetic particles 135 is made to crest in the form of a brush by the magnetic field, and then, is conveyed further by the rotation of the charging sleeve 131 to where the distance between the peripheral surface of the charging sleeve 131 and the peripheral surface of the photosensitive drum 1 is smallest. Thus, the magnetic particles 135 in the crested portion touch the peripheral surface of the photosensitive drum 1. The charging sleeves 131 and 132 are being supplied with charge bias by charge bias power sources V1 and V2 (FIG. 1), respectively. Thus, electric charge flows into the magnetic particles 135 (FIG. 4) on the peripheral surface of the charging sleeve 131, which are in the charging range. As a result, the magnetic particles 135 in the charging range become charged.

The design of the charging apparatus 2 in this embodiment is such that the charging apparatus 2 charges the peripheral surface of the photosensitive drum 1 twice per photosensitive drum rotation, with the use of two charging sleeves 131 and 132. Next, the merits of this design will be described.

A photosensitive member based on amorphous silicon is manufactured by depositing silicon on the peripheral surface of an aluminum cylinder by plasmatizing silicon with the use of high frequency waves or microwaves. Therefore, it has a problem in that if the plasma is not uniform, it forms on the aluminum cylinder, an amorphous silicon film which is non-uniform in thickness and composition, in terms of the circumferential direction of the cylinder.

Further, compared to a photosensitive member based on organic photosensitive substance, a photosensitive member based on amorphous silicon is very large in the attenuation of potential, which occurs after it is charged, even in darkness. Moreover, it is large in the attenuation of the potential attributable to image formation exposure. Therefore, an image forming apparatus employing a photosensitive member based on amorphous silicon has to be provided with a pre-exposing means, that is, a means for exposing the entirety of the photosensitive substance which makes up the peripheral surface of the photosensitive drum 1 before exposing the peripheral surface of the photosensitive drum 1 for image formation. In other words, a photosensitive drum based on amorphous silicon is very large in the attenuation of potential which occurs between the charging of the photosensitive drum and the development of the latent image on the photosensitive drum; the potential attenuates roughly 100 V-200 V. This large amount of attenuation of potential and the above-mentioned nonuniformity of the photosensitive layer (film) result in the nonuniformity in potential, in a range of roughly 10-20 V, in terms of the circumferential direction of the photosensitive member.

The presence of nonuniformity in potential as large as the above-described one results in the formation of an image which is nonuniform in density. Since a photosensitive member based on amorphous silicon is smaller in contrast than a photosensitive member based on organic photosensitive substance, the former is more susceptible to this problem than the latter.

For the problem described above, it is effective to charge a photosensitive drum two or more times before exposure. Thus, the above-mentioned increase in the attenuation of potential in darkness, which is attributable to optical memory can be reduced by charging a photosensitive drum two or more times before exposure. That is, the first charging process substantially erases the optical memory. Therefore, after the second charging process, the amount of attenuation of potential is very small. In other words, charging a photosensitive drum based on amorphous silicon two or more times before exposure can substantially improve an image forming apparatus employing a photosensitive drum based on amorphous silicon, in terms of the anomaly in the potential of the photosensitive drum, and the formation of an image suffering from a ghost attributable to the anomaly in the potential of the photosensitive drum.

(5) Structure of Electrically-Conductive End Plate

Figure 5:
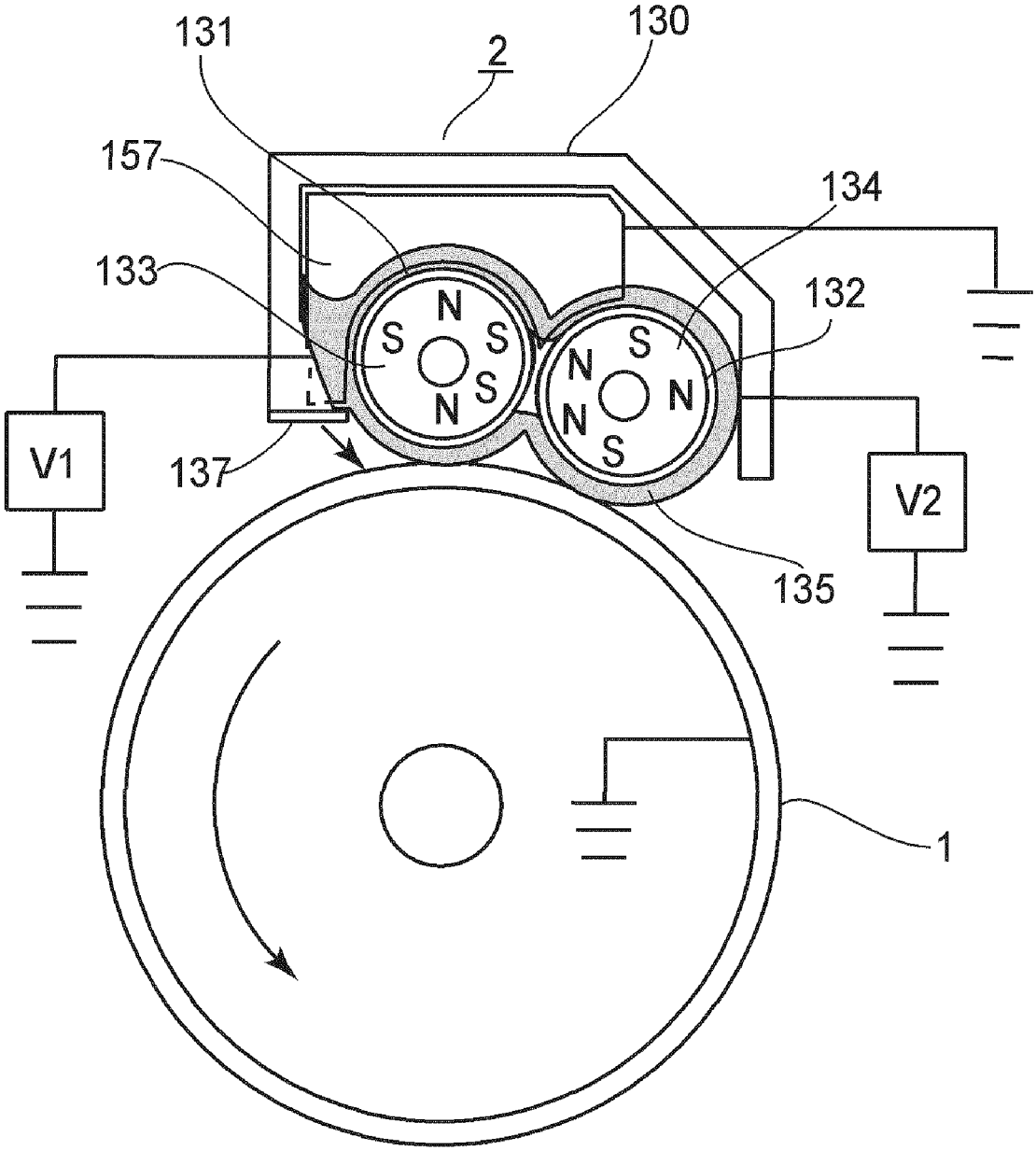
FIG. 5 is a vertical, sectional view of the charging apparatus in the first, second, fifth, sixth, and seventh embodiments of the present invention, showing the positional relationship among the first charging sleeve, second charging sleeve, and electrically-conductive member.
Figure 6:
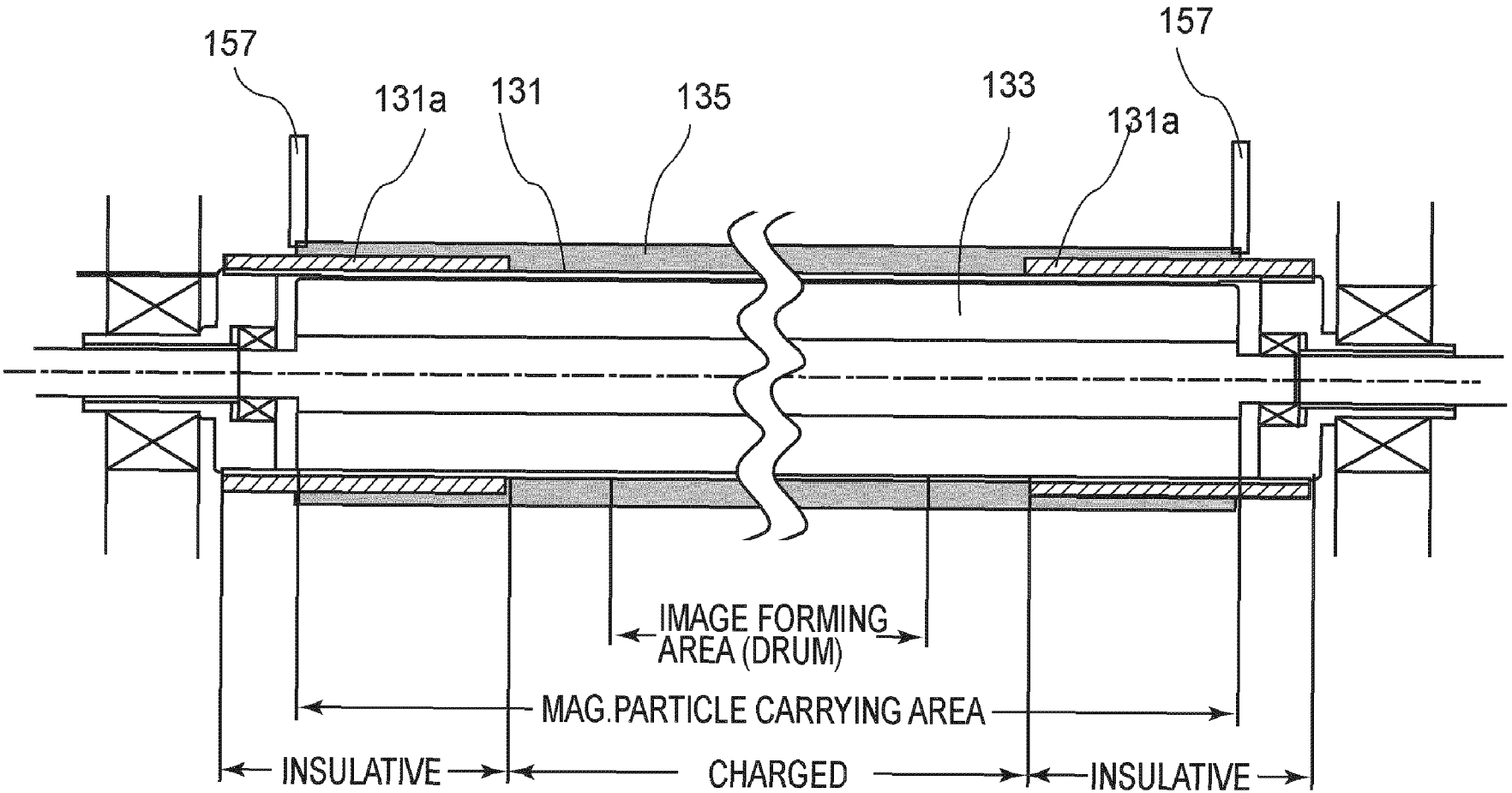
FIG. 6 is a plan view of the charging apparatus in the first, second, fourth, fifth, sixth, and seventh embodiments of the present invention, showing the positional relationship among the first charging sleeve, second charging sleeve, and electrically-conductive member.

FIG. 5 is a vertical sectional view of the charging apparatus 2 in this embodiment, and shows the structure of the apparatus. FIG. 6 is a plan view of the charging apparatus 2, and shows the positional relationship between the first charging sleeve 131 and electrically-conductive member 157 of the apparatus. Incidentally, the positional relationship between the second charging sleeve 132 and the conductive member 157 is the same as that between the first charging sleeve 131 and conductive member 157.

The conductive member 157 is attached to the inward surface of the charging means housing 130 so that the position of the conductive member 157 corresponds to the edge of the portion of the sleeve 131 (132), in the magnetic particle bearing range, and also, so that a preset amount of distance is provided between the conductive member 157 and sleeve 131 (132) to prevent the conductive member 157 from coming into contact with the peripheral surface (magnetic particle bearing surface) of the sleeve 131 (132). The conductive member 157 is not to be attached to the photosensitive drum 1; it is to be independent from the photosensitive drum 1. The conductive member 157 is in contact with an unshown grounded contact point, which is outside the charging apparatus 2. Therefore, even if electric charge moves to the conductive member 157, the conductive member 157 does not retain the electric charge. Further, even if the magnetic particles in the adjacencies of the conductive member 157 acquire electric charge, the acquired electric charge is discharged out of the charging apparatus 2 through the conductive member 157. The conductive member 157 is formed of magnetized iron, and magnetically confines the magnetic particles 135 in the adjacencies of the conductive member 157.

(6) Measurement of Amount of Magnetic Particles Having Adhered to Lengthwise Ends of Photosensitive Drum For the purpose of confirming that it is possible to reduce the amount by which the magnetic particles 135 adhere to the lengthwise end portions of the photosensitive drum 1, the amount of the magnetic particles 135 having adhered to the lengthwise ends of the photosensitive drum 1 in this embodiment was measured. As a charging apparatus with which the charging apparatus 2 in this embodiment is to be compared, a charging apparatus (which hereafter will be referred to as conventional charging apparatus), the conductive member (157) of which is not grounded and is not in contact with any of the structural components of the charging apparatus, was employed. The conventional charging apparatus is similar in structure to the charging apparatus 2 in this embodiment, except that the conductive member (157) of the conventional charging apparatus is not grounded. The photosensitive drum 1 is 84 mm in diameter, and rotates at a peripheral velocity of 276 mm/sec.

Both the charging apparatus 2 in this embodiment and conventional charging apparatus are 16 mm in the diameter of the first charging sleeves 131, and 22 mm in the diameter of the second charging sleeve 132. Both the first and second charging sleeves 131 and 132 are 86 mm/sec in peripheral velocity. They both have been blasted with Alundum #60.

The charging means housing 130 was filled with 100 g of magnetic particles 135. During the charging of the photosensitive drum 1, a charge bias made up of 600 V of DC voltage, and AC voltage which was 300 V in peak-to-peak voltage and 1 kHz in frequency, was applied to the charging sleeve 131 from a charge bias power source V1. To the sleeve 132, a charge bias made up of DC voltage which was 750 V in magnitude, and AC voltage which was 300 V in peak-to-peak voltage and 1 kHz in frequency, was applied to the sleeve 131 from the charge bias power source V2.

As described previously, the adhesion of the magnetic particles 135 to the photosensitive drum 1 occurs primarily across the portions of the photosensitive drum 1, which correspond to the lengthwise end portions of the charging sleeves 131 and 132; it hardly occurs across the portion of the photosensitive drum 1, which corresponds to the center portions of the charging sleeves 131 and 132, that is, the portions other than the lengthwise end portions. Therefore, by measuring the amount of magnetic particles 135 having adhered to the lengthwise end portions of the photosensitive drum 1, which correspond to the lengthwise end portions of the charging sleeves 131 and 132, it is possible to determine whether or not the amount by which the magnetic particles 135 adhere to the photosensitive drum 1 is within the range tolerable to the charging sleeves 131 and 132.

FIG. 1 shows the means for measuring the amount of magnetic particles 135 having adhered to the lengthwise end portions of the photosensitive drum 1. A pair of plastic magnets 151 is positioned so that they oppose the lengthwise end portions of the photosensitive drum 1, one for one, with the presence of a minute gap. In terms of the rotational direction of the photosensitive drum 1, the plastic magnets 151 are positioned on the downstream side of the charging apparatus 2. By these magnets 151, the magnetic particles 135 having adhered to the lengthwise end portions of the photosensitive drum 1 are magnetically captured. Then, the magnetic particles 135 captured by the magnets 151 are collected by a suctioning device. The amount of the collected magnetic particles is measured by an electronic balance.

In actual tests, the image forming apparatus was idled for two minutes, and then, the amount of the magnetic particles 135 having adhered to the lengthwise end portions of the photosensitive drum 1 was measured with the use of the above-described method. Incidentally, while idling the image forming apparatus, the same voltage as that applied to the charging apparatus 2 while actually forming an image, was applied to the charging apparatus 2, and no voltage was applied to the developing devices and transferring apparatus.

In the case of the conventional charging apparatus (comparative apparatus), that is, a charging apparatus having no conductive member 157, 23 mg of magnetic particles 135 were captured by the magnets 151 after the image forming apparatus was idled under the above-described condition. In comparison, in the case of the charging apparatus 2 in this embodiment, 3 mg of magnetic particles 135 were captured by the magnets 151. It became evident from the results of these tests that the employment of the charging apparatus 2 in this embodiment substantially reduced the amount by which the magnetic particles 135 adhere to the lengthwise end portions of the photosensitive drum 1.

To analyze these results, in the case of the conventional charging apparatus, as a preset voltage is applied to the sleeve 131, electric charge flows into the regulating blade 137 through the magnetic particles 135 borne on the portions of the peripheral surface of the sleeve 131, which are in the charging range. Thus, the potential of the regulating blade 137 increases to a value which is close to that of the voltage applied to the sleeve 131. Further, electric charge flows into the magnetic particles 135 on the insulated portion 131 a of the peripheral surface of the sleeve 131, from the lengthwise end portions of the regulating blade 137, the potential of which has increased to value of the voltage applied to the sleeve 131. Moreover, electric charge flows into the magnetic particles 135 on the sleeve 131, which are outside the charging range, from the magnetic particles 135 on the sleeve 131, which are in the adjacencies of the edges of the charging range, that is, the borderline between the charging range and insulated portion of the sleeve 131. Thus, even though the magnetic particles on the sleeve 131, which are outside the charging range of the sleeve 131, do not directly receive electric charge from the sleeves 131 and 132, they indirectly receive electric charge through the magnetic particles 135 on the sleeve 131, which are in the charging range of the 131 and adjacent to the borderline between the charging range and insulated range of the sleeve 131. As the magnetic particles 135 on the sleeve 131, which are outside the charging range, acquire electric charge, they are subjected to mirror force. As a result, they move onto the photosensitive drum 1, and adhere to the photosensitive member 1.

In comparison, in the case of the charging apparatus 2 in this embodiment, the conductive member 157 is electrically in contact with the grounded contact point which is outside the charging means housing 130. Thus, the electric charge which the magnetic particles 135 in the adjacencies of the conductive member 157 have, moves into the conductive member 157, through which they escape out of the charging means housing 130. Therefore, the amount of mirror force to which the magnetic particles 135 are subjected is smaller, and therefore, the amount by which the magnetic particles 135 move onto the photosensitive drum 1 is smaller than in the case of the conventional charging apparatus. Further, since electric charge moves from the magnetic particles 135 to the conductive member 157, electric charge is likely to collect in the magnetic particles 135 in the adjacencies of the conductive member 157. Therefore, a mirror force is likely to be generated between the magnetic particles 135 in the adjacencies of the conductive member 157, and the conductive member 157. In this embodiment, the portion of the surface of the conductive member 157, to which the magnetic particles 135 contact, is always in contact with the magnetic particles 135. Therefore, even if the magnetic particles 135 adhere to the conductive member 157 due to the occurrence of the mirror force, this adhesion of magnetic particles 135 to the conductive member 157 does not result in the adhesion of magnetic particles 135 to the photosensitive drum 1. That is, the phenomenon that as a member to be charged (that is, photosensitive drum) is rotated, the magnetic particles 135 adhere to the peripheral surface of the member to be charged, while the member is rotated, as described in Japanese Laid-open Patent Application 2006-163296 described previously, is unlikely to occur.

Also in the case of the charging apparatus 2 in this embodiment, the amount by which the magnetic particles 135 are adhered to the lengthwise end portions of the photosensitive drum 1 is substantially smaller than in the case of a conventional charging apparatus. Therefore, the charging apparatus 2 in this embodiment can prevent the problem that an image forming apparatus reduces in image quality due to the entrance of the magnetic particles 135 into the developing device. Further, the charging apparatus 2 in this embodiment can reduce the likeliness of an image being unsatisfactorily transferred in the transferring portion, and also, can reduce in severity the damages which the cleaner might cause to the peripheral surface of the photosensitive drum 1. Therefore, the employment of the charging apparatus 2 in this embodiment by an image forming apparatus can keep the performance of the image forming apparatus stable at a satisfactorily level for a long time.

Also in the case of the charging apparatus 2 in this embodiment, magnetized iron is used as the material for the conductive member 157. Therefore, the electric charge having accumulated in the magnetic particles 135 can be discharged out of the charging apparatus 2 by attracting the magnetic particles 135 in the adjacencies of the conductive member 157, to the conductive member 157 by the magnetic force which the conductive member 157 has. Therefore, in the case of the charging apparatus 2 in this embodiment, the magnetic particles 135 are far less likely to be affected by a mirror force, being therefore substantially smaller in the amount by which they move onto the photosensitive drum 1, than in the case of a charging apparatus whose conductive member (157) is not a magnetic member.

Further, the conductive member 157 magnetically confines the magnetic particles 135 on the lengthwise end portions of the peripheral surface of the charging sleeves 131 and 132, which are unstable in the amount of force for retaining the magnetic particles 135. Therefore, the charging apparatus 2 in this embodiment is substantially smaller in the amount by which the magnetic particles 135 move onto the lengthwise end portions of the charging sleeves 131 and 132, which do not have the magnetic force large enough for reliably retaining the magnetic particles 135, being therefore substantially smaller in the amount by which the magnetic particles 135 leak out of the charging apparatus 2.

Incidentally, in the case of the charging apparatus 2 in this embodiment, the conductive member 157 is positioned so that its position falls within the insulated range of the peripheral surface of the charging sleeve 131. However, the design and positioning of the conductive member 157 do not need to be as described above. For example, the conductive member 157 may be shaped and positioned so that it straddles the borderline between the charging range and insulated range of the peripheral surface of the charging sleeve 131, because such an arrangement can also allow the electric charge to escape from the magnetic particles 135 on the insulated portion of the peripheral surface of the charging sleeve, and then, out of the charging apparatus 2. Therefore, the charging apparatus in this embodiment is smaller in the amount by which the magnetic particles 135 move onto the photosensitive drum 1 and adhere thereto than a conventional charging apparatus.

However, in the case of the charging apparatus 2 in this embodiment, the electric charge which the magnetic particles 135 on the charging range of the charging sleeve have is discharged out of the charging apparatus. Therefore, it is possible that it will become impossible to charge the portion of the photosensitive drum 1, which corresponds to the charging portion of the charging sleeve, to a preset potential level. Therefore, it is desired that the conductive member 157 is positioned so that its position falls within the range which correspond to the insulated portion of the peripheral surface of the charging sleeves, in terms of the lengthwise direction of the charging sleeves.

Further, in the case of the charging apparatus 2 in this embodiment, the conductive member 157 is positioned so that it straddles the borderline between the range which corresponds to the magnetic particle bearing portion of the peripheral surface of the charging sleeve, and the range which corresponds to the portion of the peripheral surface of the charging sleeve, across which no magnetic particles are borne. Therefore, the conductive member 157 magnetically confines the magnetic particles 135, which are on the portion of the peripheral surface of the charging sleeves 131 and 132, which are most unstable in the amount of the magnetic force from their internal magnets. In other words, the conductive member 157 compensates for the instability in the amount of magnetic force across the lengthwise end portions of the peripheral surfaces of the charging sleeves 131 and 132, reducing thereby the amount by which the magnetic particles 135 escape from the magnetic particles bearing portions of the peripheral surfaces of the charging sleeves 131 and 132, onto the portions of the peripheral surfaces of the charging sleeves 131 and 132, which are outside the magnetic particle bearing portion, and then, leak out of the charging apparatus 2.

Further, in this embodiment, the conductive member 157 is attached to the inward surface of the of the charging means housing 130 so that a preset amount of distance is provided between the conductive member 157 and sleeve 131 (132) to prevent the conductive member 157 from coming into contact with the peripheral surface (magnetic particle bearing surface) of the sleeve 131 (132). The smaller the distance between the conductive member 157 and sleeve 131 (132), the smaller the amount by which the magnetic particles 135 adhere to the photosensitive drum 1.

Also in the case of the charging apparatus 2 in this embodiment, the magnetic particles 135 are prevented from adhering to the photosensitive drum 1, with the employment of a very simple structural arrangement, that is, by attaching the conductive member 157 inside the charging means housing 130 and grounding the conductive member 157. In other words, this embodiment makes it possible to reduce the amount by which the magnetic particles 135 adhere to the photosensitive drum 1, without using a very costly method, such as drastically modifying the photosensitive drum 1.

Figure 7:
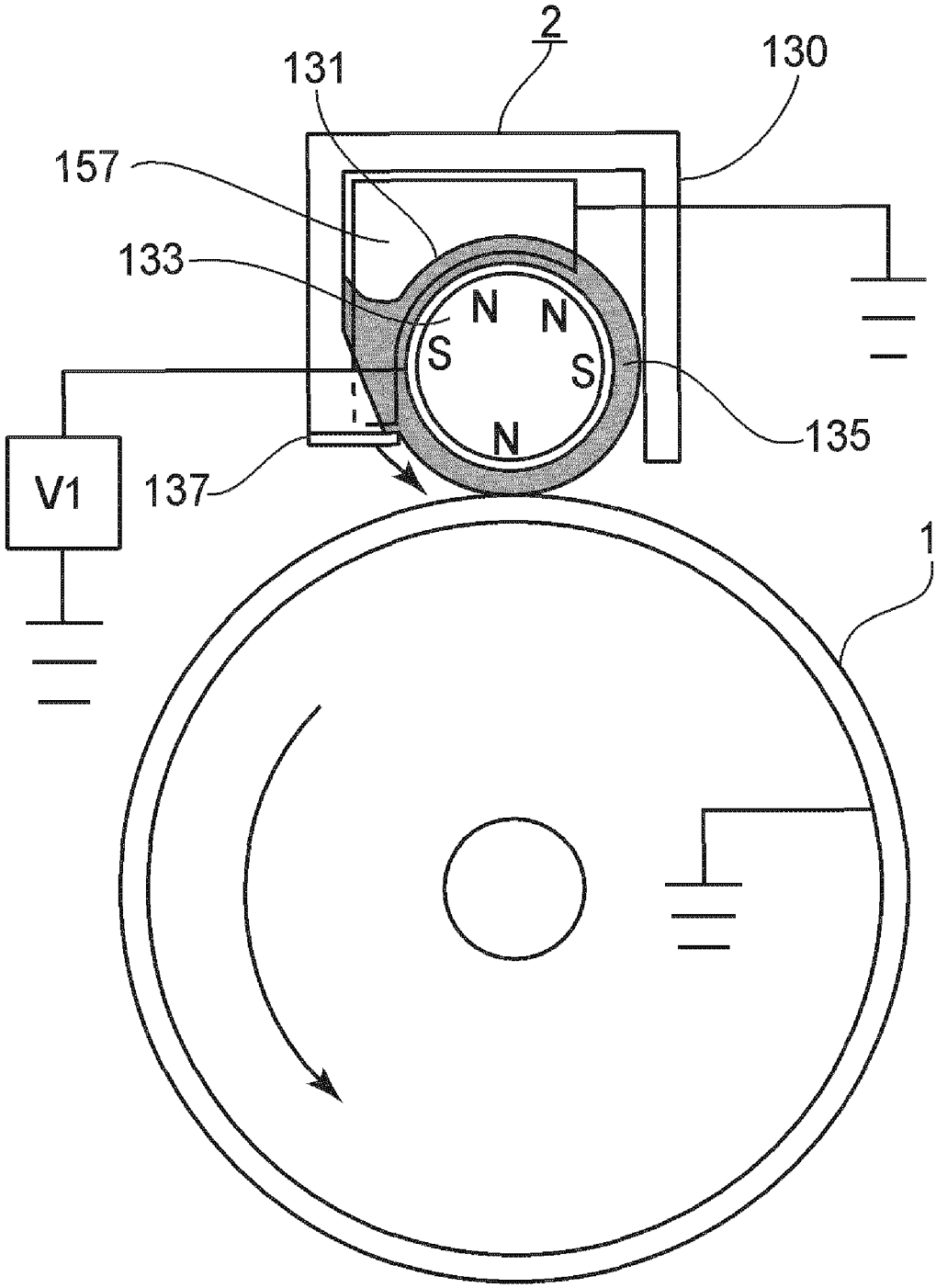
FIG. 7 is a vertical, sectional view of the charging apparatus having only a single charging sleeve, showing the positional relationship between the charging sleeve and electrically-conductive member 157.

Incidentally, in this embodiment, a charging apparatus having two charging sleeves was used as the charging apparatus 2. However, the present invention is also applicable to a charging apparatus, such as the one shown in FIG. 7, which has only a single charging sleeve, just as effectively as it is to a charging apparatus having two charging sleeves; the application can control the amount by which the magnetic particles 135 adhere to the photosensitive drum 1, just as effectively as it does when it is applied to the charging apparatus having two charging sleeves.

Embodiment 2

This embodiment is different from the first embodiment in that the conductive member 157 of the charging apparatus in this embodiment is different in material from that in the first embodiment. The material for the conductive member 157 of the charging apparatus 2 in this embodiment is nonmagnetic SUS.

The charging apparatus in this embodiment is the same in structure as the charging apparatus 2 in the first embodiment, except that the material of the conductive member 157 of the charging apparatus 2 in this embodiment is nonmagnetic SUS. Thus, the components, portions, etc., of the charging apparatus in this embodiment, which are the same as those in the first embodiment are given the same referential symbols as those given to the counterparts in the first embodiment, and will not be described. The arrangement regarding the referential symbols is also true with the third, fourth, and fifth embodiments.

For the purpose of confirming that the charging apparatus 2 in this embodiment is also substantially smaller in the amount by which the magnetic particles 135 adhere to the lengthwise end portions of the photosensitive drum 1 than a conventional charging apparatus, the amount of the magnetic particles 135 having adhered to the lengthwise portions of the photosensitive drum 1 was measured with the use of the same method as the one used to measure the amount of the magnetic particles 135 which adhered to the photosensitive drum 1 in the first embodiment.

In the case of the charging apparatus 2 in this embodiment, 5 mg of magnetic particles 135 were captured by the magnets 151. It is evident from this result that the employment of the charging apparatus 2 in this embodiment substantially reduces the amount by which the magnetic particles 135 adhere to the lengthwise end portions of the photosensitive drum 1, compared to 23 mg of the magnetic particles 135 captured when the comparative charging apparatus, that is, a conventional charging apparatus whose conductive member was not grounded was employed.

The material for the conductive member 157 of the charging apparatus 2 in this embodiment is nonmagnetic SUS. In other words, in this embodiment, the magnetic particles 135 on the portions of the peripheral surface of the charging sleeve, which are unstable in magnetic particle retention, are not confined by the magnetic force. Yet, the charging apparatus 2 in this embodiment is also substantially smaller in the amount by which the magnetic particles 135 are adhered to the lengthwise end portions of the photosensitive drum 1 than a conventional charging apparatus, because the electric charge which the magnetic particles 135 on the insulated portions of the peripheral surface of the charging sleeve is also released out of the charging apparatus 2.

Incidentally, in this embodiment, a charging apparatus having two charging sleeves was used as the charging apparatus 2. However, the present invention is also applicable to a charging apparatus, such as the one shown in FIG. 7, which has only a single charging sleeve, just as effectively as it is to a charging apparatus having two charging sleeves; the application can control the amount by which the magnetic particles 135 adhere to the photosensitive drum 1, just as effectively as it does when it is applied to the charging apparatus having two charging sleeves.

Embodiment 3

Figure 9:
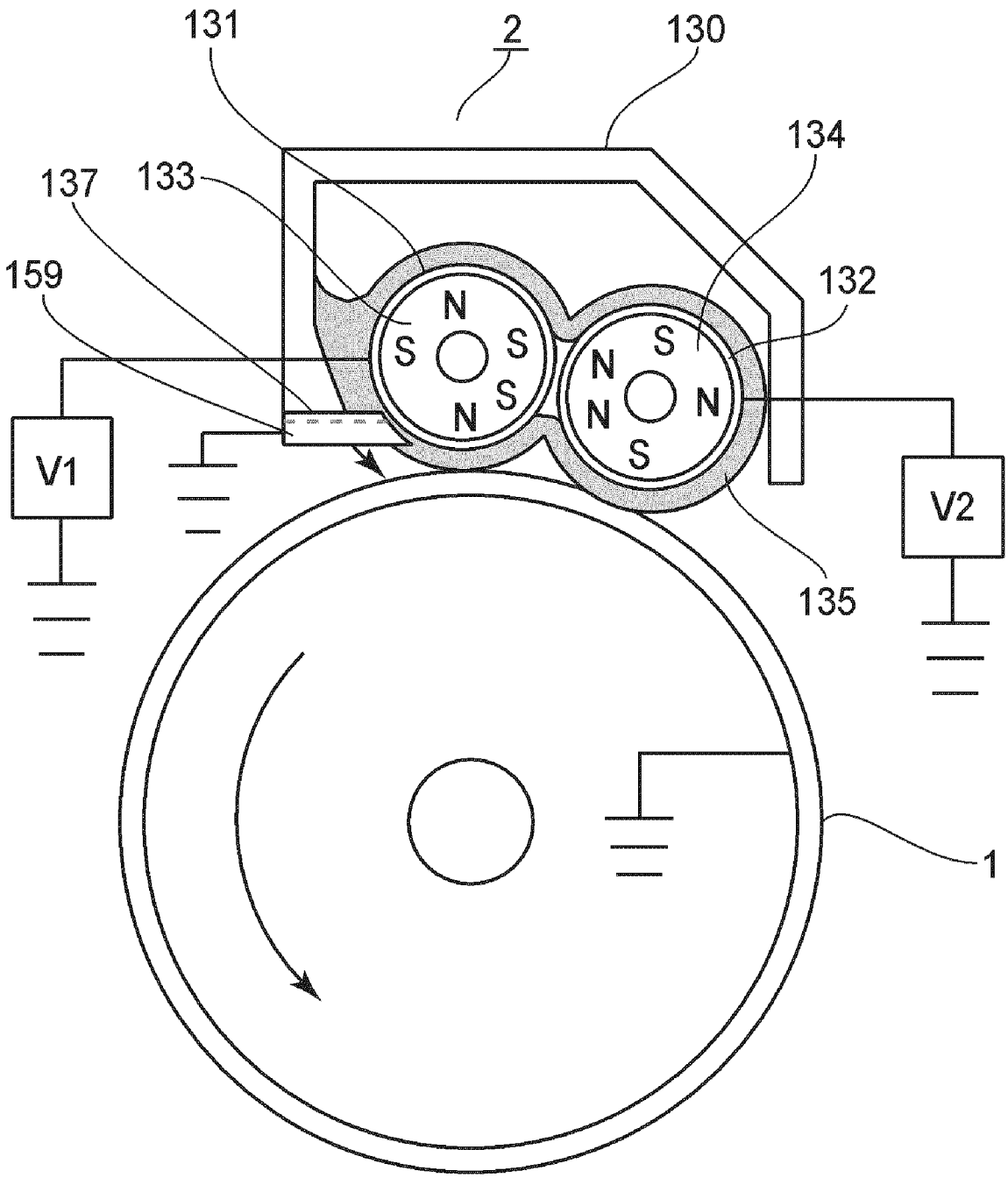
FIG. 9 is a sectional view of the charging apparatus in the third embodiment, showing the location of the electrically-conductive member.
Figure 10:
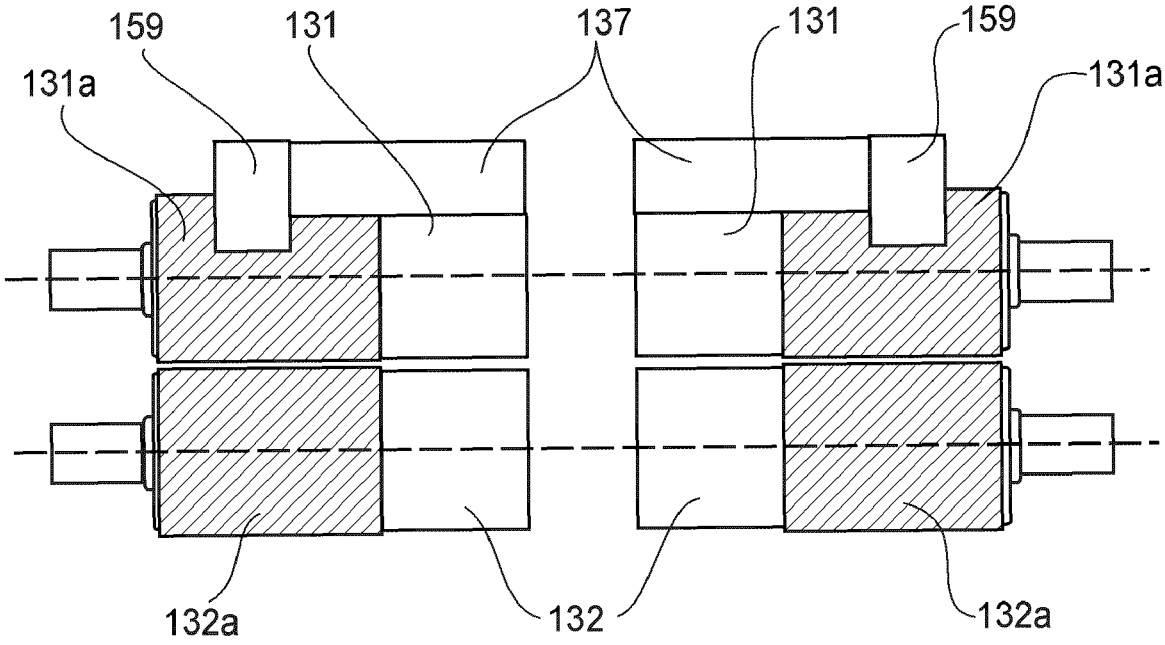
FIG. 10 is a plan view of the charging apparatus in the third embodiment, showing the location of the electrically-conductive member.

FIG. 9 is a vertical, sectional view of the charging apparatus used in this embodiment, showing the relationship between the charging apparatus 2 and photosensitive drum 1. FIG. 10 is a plan view of the charging apparatus used in the this embodiment, showing the positional relationship among the first charging sleeve 131, second charging sleeve 132, and conductive member 159. The portion of the charging apparatus 2 shown in FIG. 10 is the same portion of the charging apparatus 2 as the portion shown in FIG. 9, except that the photosensitive drum 1 is not shown in FIG. 10, in which the two charging sleeves are seen from the bottom side of the charging apparatus 2.

The charging apparatus 2 in this embodiment is different from the charging apparatus 2 in the first embodiment in that the charging apparatus in this embodiment does not have the same conductive member as the conductive member 157 attached to the inward surface of the charging means housing 130 in the first embodiment. Instead, the charging apparatus 2 in this embodiment is provided with a conductive member 159, which is positioned between the downstream side of the S-B gap, in terms of the rotational direction of the sleeve 131, and the S-D gap, that is, the gap between the sleeve 131 and photosensitive drum 1. The conductive member 159 is positioned so that it contacts the magnetic particles 135 which are on the lengthwise end, more specifically, insulated portion, of the peripheral surface of the charging sleeve 131. Otherwise, the charging apparatus 2 in this embodiment is the same in structure as the charging apparatus 2 in the first embodiment. The conductive member 159 is in the form of a piece of plate and is 0.5 mm in thickness. It is formed of nonmagnetic SUS. Further, the conductive member 159 is attached so that, in terms of the lengthwise direction of the sleeve 131, the entirety of its surface which opposes the sleeve 131 falls within the range of the insulated portion 131*a* of the peripheral surface of the charging sleeve 131. The conductive member 159 is electrically in contact with an unshown grounded contact point, which is outside the charging apparatus 2.

Also in the case of the charging apparatus 2 in this embodiment, for the purpose of confirming that the charging apparatus 2 in this embodiment is also substantially smaller in the amount by which the magnetic particles 135 adhere to the lengthwise end portions of the photosensitive drum 1 than a conventional charging apparatus, the amount of the magnetic particles 135 having adhered to the lengthwise portions of the photosensitive drum 1 was measured with the use of the same method as the one used to measure the amount of the magnetic particles 135 which adhered to the photosensitive drum 1 in the first embodiment.

In the case of the charging apparatus 2 in this embodiment, 4 mg of magnetic particles 135 were captured by the magnets 151. It is evident from this result that the employment of the charging apparatus 2 in this embodiment substantially reduces the amount by which the magnetic particles 135 adhere to the lengthwise end portions of the photosensitive drum 1, compared to 23 mg of the magnetic particles 135 captured when the comparative charging apparatus, that is, a conventional charging apparatus whose conductive member 157 was not grounded was employed. It is also evident from this result that even if a charging apparatus is structured, as is the charging apparatus in this embodiment, so that the electric charge of the magnetic particles 135 on the charging sleeve 131 is discharged after the magnetic particles 135 are moved past the regulating blade 137 by the rotation of the charging sleeve 131, the same effects as those obtained by the charging apparatus in the first embodiment can be obtained.

Incidentally, in this embodiment, a charging apparatus having two charging sleeves was used as the charging apparatus 2. However, the present invention is also applicable to a charging apparatus, such as the one shown in FIG. 7, which has only a single charging sleeve, just as effectively as it is to a charging apparatus having two charging sleeves; the application can control the amount by which the magnetic particles 135 adhere to the photosensitive drum 1, just as effectively as it does when it is applied to a charging apparatus like the charging apparatus in this embodiment having two charging sleeves.

Embodiment 4

Figure 11:
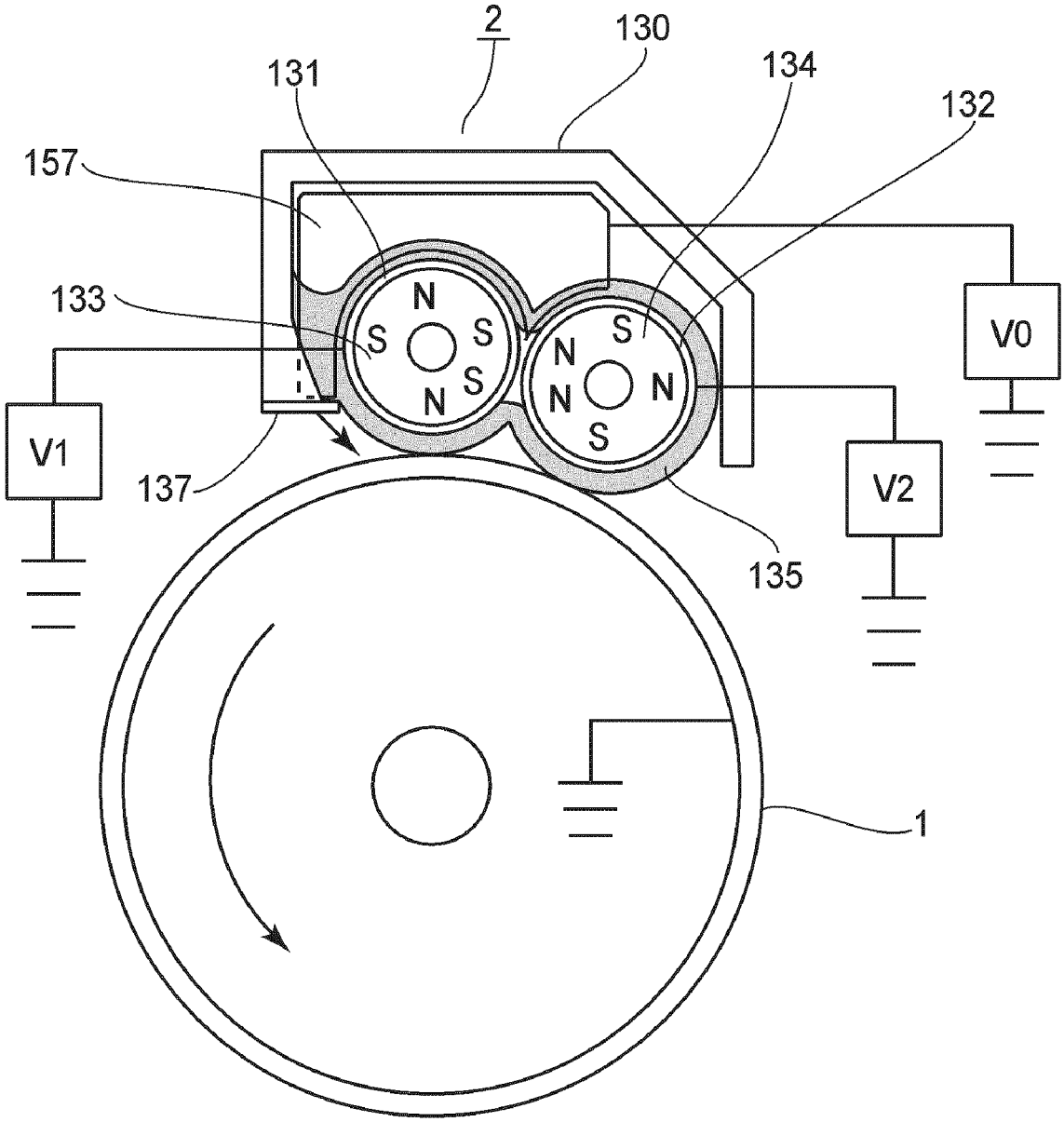
FIG. 11 is a schematic, sectional view of the charging apparatus and photosensitive drum in the fourth embodiment, showing the relationship between the charging apparatus and photosensitive drum.

FIG. 11 is a vertical, sectional view of the charging apparatus in this embodiment, showing the relationship between the charging apparatus 2 and photosensitive drum 1 of the apparatus. The charging apparatus in this embodiment is the same in structure as the charging apparatus 2 in the first embodiment, except that the conductive member 157 in this embodiment is not electrically in contact with a grounded contact point, but, instead, is connected to an electrical power source VO for supplying voltage.

Also in the case of the charging apparatus in this embodiment, the amount of the magnetic particles 135 having adhered to the lengthwise portions of the photosensitive drum 1 was measured with the use of the same method as the one used to measure the amount of magnetic particles 135 which adhered to the photosensitive drum 1 in the first embodiment, except that the value of the voltage applied to the power source V0 was set to 0V.

In the case of the charging apparatus in this embodiment, 3 mg of magnetic particles 135 were recovered by the magnets 151. It is evident from this result that the employment of the charging apparatus 2 in this embodiment substantially reduces the amount by which the magnetic particles 135 adhere to the lengthwise end portions of the photosensitive drum 1. It is also evident from this result that the charging apparatus in this embodiment offers the same effects as the charging apparatus 2 in the first embodiment.

Further, in the case of the charging apparatus in this embodiment, the amount of the magnetic particles 135 having adhered to the lengthwise ends of the photosensitive drum 1 was measured while increasing in steps the value of the voltage applied to the electric power source V0 from 0 to 800, with the use of the same method as the one used to measure the amount of the magnetic particles 135 which adhered to the photosensitive drum 1 in the first embodiment. From the results of this measurement, it was possible to confirm that as long as the value of the voltage applied to the electric power source V0 is no higher than 100, and also, that when the value of the voltage applied to the electric power source V0 was no less than 100, this embodiment was not as effective as when the voltage applied to the electric power source V0 was no higher than 100, although the amount of the magnetic particles 135 having adhered to the lengthwise ends of the photosensitive drum 1 never exceeded the amount of the magnetic particles 135 which adhered to the lengthwise ends of the photosensitive drum 1 when a charging apparatus whose conductive member 157 was electrically floated. Further, when the value of the voltage applied to the electric power source V0 was set to a value higher than 600, that is, the value of the charge voltage, the charging apparatus in this embodiment was not effective to reduce the amount by which the magnetic particles 135 adhere to the lengthwise ends of the photosensitive drum 1, below the amount of the magnetic particles 135 which adhered to the lengthwise ends of the photosensitive drum 1 when a charging apparatus, such as a conventional one, whose conductive member 157 was electrically floated was employed; instead, the amount of adhesion increased. In other words, as long as the voltage applied to the conductive member 157 is set so that its absolute value is no higher than the absolute value of the voltage applied to the charging sleeve, the charging apparatus in this embodiment can substantially reduce the amount of the magnetic particle adhesion. Moreover, it became evident that the effects were greater when the absolute value of the voltage applied to the conductive member 157 was no higher than 100.

Incidentally, even if the value of the voltage applied to the electric power source V0 is increased in the negative direction from 0, the electric charge having accumulated in the magnetic particles 135 escapes into the conductive member 157 as it does when the value of the voltage applied to the electric power source V0 is positive. Therefore, applying negative voltage to the power source V0 is also effective to reduce the amount by which the magnetic particles 135 adhere to the lengthwise ends of the photosensitive drum 1. However, when the absolute value of the voltage applied to the electric power source V0 was no less than 600, that is, the value of the charge voltage, the charging apparatus in this embodiment was not effective to reduce the amount by which the magnetic particles 135 adhere to the lengthwise ends of the photosensitive drum 1. The reason therefor seems to be that the electric charge having accumulated in the magnetic particles 135 was not allowed to escape into the conductive member 157, and instead, electric charge is supplied to the magnetic particles 135 from the conductive member 157.

Incidentally, in this embodiment, a charging apparatus having two charging sleeves was used as the charging apparatus 2. However, the present invention is also applicable to a charging apparatus, such as the one shown in FIG. 7, which has only a single charging sleeve, just as effectively as it is to a charging apparatus having two charging sleeves; the application can control the amount by which the magnetic particles 135 adhere to the photosensitive drum 1, just as effectively as it does when it is applied to a charging apparatus like the charging apparatus in this embodiment having two charging sleeves.

Embodiment 5

Figure 12:
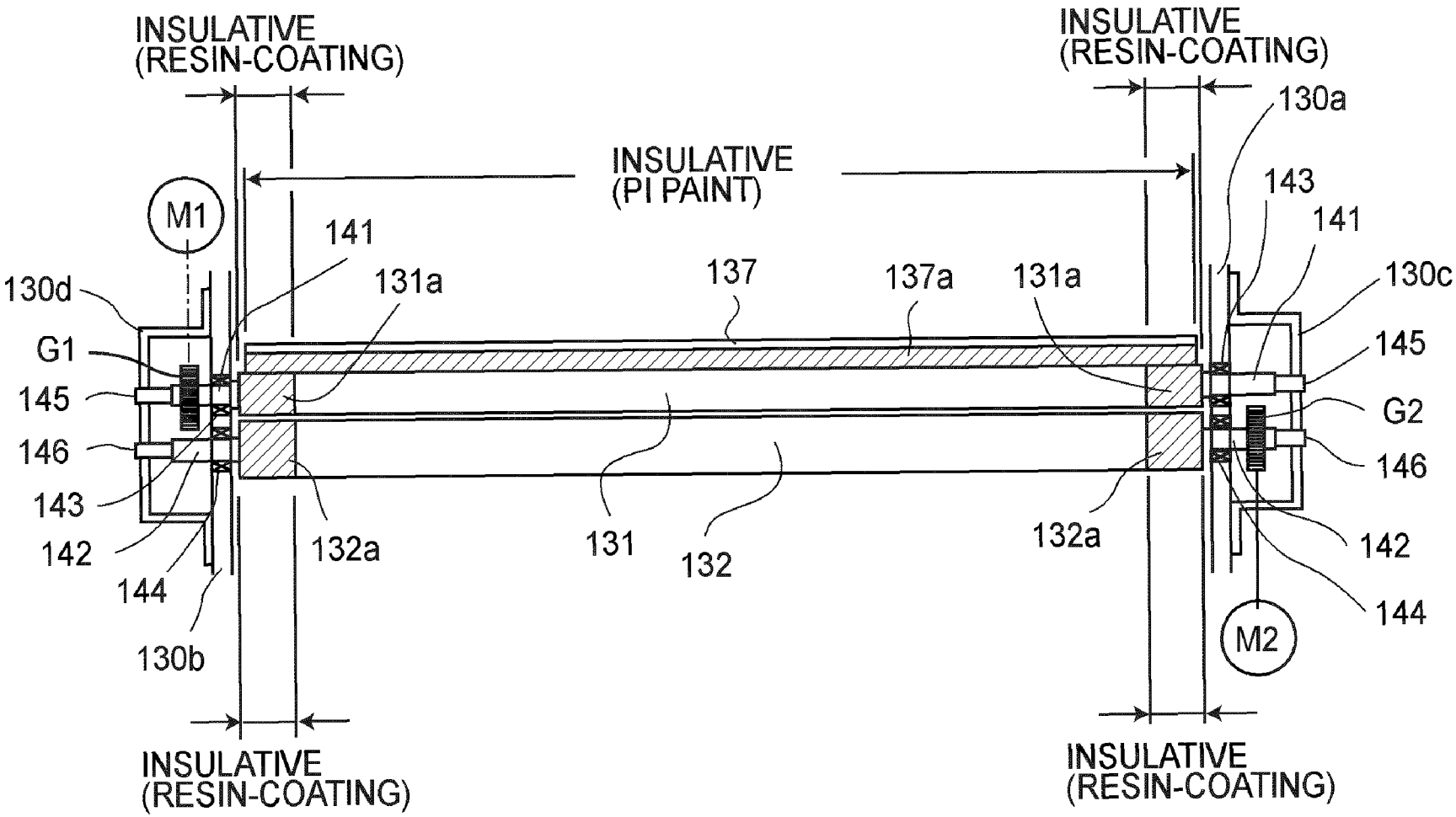
FIG. 12 is a plan view of the charging apparatus in the fifth embodiment of the present invention, showing the relationship among the first charging sleeve, second charging sleeve, and regulating blade of the charging apparatus.

FIG. 12 is a plan view of the charging apparatus in this embodiment of the present invention, showing the relationship among the first charging sleeve, second charging sleeve, and regulating blade of the charging apparatus. In this embodiment, the regulating blade 137 is coated with an electrically insulating substance across the entire range in its lengthwise direction. Otherwise, the charging apparatus 2 in this embodiment is the same as the conventional charging apparatus described as the comparative apparatus to the charging apparatus 2 in the first embodiment. More specifically, the conductive members 157 in this embodiment are also positioned so that their positions correspond to the lengthwise end portions of the charging sleeves 131 and 132 as shown in FIGS. 5 and 6. However, the conductive members 157 in this embodiment are not grounded.

In this embodiment, the adhesion of the magnetic particles 135 to the lengthwise end portions of the photosensitive drum 1 is prevented by preventing electric charge from moving into the magnetic particles on the end portions of the charging sleeve 131 (132), instead of making the electric charge of the magnetic particles 135 on the end portions of the peripheral surfaces of the charging sleeve 131 (132) escape.

Referring to FIG. 12, the sleeves 131 and 132 are coated with resin across their lengthwise end portions (first insulated portions 131*a* and 132*a*). The thickness of the resin coat is roughly 50 μm. The insulated portions 131*a* keep the magnetic particles 135 on the insulated portions, that is, the lengthwise end portions, of the peripheral surface of the sleeve 131, electrically insulated from the sleeve 131. The insulated portions 132*a* keep the magnetic particles 135 on the insulated portions, that is, the lengthwise end portions, of the peripheral surface of the sleeve 132, electrically insulated from the sleeve 132.

Further, the regulating blade 137 is coated with PI (polyimide) across the entire range in terms of its lengthwise direction. This coated portion of the regulating blade 137 will be referred to as a PI portion (second insulated portion). Incidentally, the portion of the regulating blade 137, which is coated with PI, may be referred to as an insulated portion 137*a*. In this embodiment, a SUS blade coated with PI is used as the regulating blade 137. The thickness of the PI layer is roughly 10 μm. The insulated portion 137*a* keeps the magnetic particles 135 on the sleeve 131 electrically insulated from the regulating blade 137, across the entire range of the regulating blade 137 in terms of the lengthwise direction of the regulating blade 137. Incidentally, the insulating substance (PI) must be coated so that it covers at least the portions of the regulating blade, which correspond to the insulated portions (coated with resin) of the charging sleeve. The portions of the regulating blade, which correspond to the insulated portions of the charging sleeve, are the portions that coincide in position with the lengthwise end portions of the charging sleeve 131 and regulating blade 137. This insulated portion of the regulating blade 137 is provided for preventing electric charge from being injected into the magnetic particles on the insulated portion of the peripheral surface of the charging sleeve, from the regulating blade 137.

The regulating blade 137 is insulated across the entirety range in terms of its lengthwise direction. Therefore, it can prevent electric charge from flowing into the regulating blade 137. Therefore, it does not occur that the regulating blade 137 is charged to the same potential level as the sleeve 131. Therefore, it does not occur that electric charge flows into the magnetic particles 135 on the lengthwise end portions of the charging sleeve 131 from the regulating blade 137. Thus, the charging apparatus in this embodiment is substantially smaller in the amount by which the magnetic particles 135 on the insulated portions 131*a* of the charging sleeve 131 adhere to the lengthwise end portions of the photosensitive drum 1 than a conventional charging apparatus.

For the purpose of confirming that the charging apparatus 2 in this embodiment is also substantially smaller in the amount by which the magnetic particles 135 adhere to the lengthwise end portions of the photosensitive drum 1 than a conventional charging apparatus, the amount of the magnetic particles 135 having adhered to the lengthwise portions of the photosensitive drum 1 was measured with the use of the same method as the one used to measure the amount of the magnetic particles 135 which adhered to the photosensitive drum 1 in the first embodiment.

In the case of the charging apparatus in this embodiment, 15 mg of magnetic particles 135 were captured by the magnets 151. In the tests in which a charging apparatus, such as a conventional charging apparatus, whose regulating blade was not electrically insulated was employed, 23 mg of magnetic particles 135 was captured by the magnets 151. It is evident from this result that the employment of the charging apparatus 2 in this embodiment substantially reduces the amount by which the magnetic particles 135 adhere to the lengthwise end portions of the photosensitive drum 1.

Thus, the employment of the charging apparatus 2 in this embodiment can prevent the problem that an image forming apparatus reduces in image quality due to the entrance of the magnetic particles 135 into the developing apparatus. Further, it can prevent the problem that a toner image is unsatisfactorily transferred in the transfer portion, and also, can reduce the severity with which the peripheral surface of the photosensitive drum 1 is damaged by the cleaner. In other words, the charging apparatus in this embodiment can keep an image forming apparatus of the magnetic brush type stable in performance for a long time.

In this embodiment, in order to electrically insulate the regulating blade 137 across the entire range in terms of its lengthwise direction, the surface of the regulating blade 137 was coated with PI. However, the same effects can be obtained by electrostatically coating the surface of the regulating blade 137 with powder of an insulating substance. Further, the same effects can also be obtained by forming the regulating blade 137 of an electrically insulative substance. In such a case, a hard substance, such as ceramic, is preferable as the material for the regulating blade 137, because whenever the photosensitive drum 1 is charged by the sleeves 131 and 132, there is friction between the regulating blade 137 and magnetic particles 135.

Incidentally, in this embodiment, a charging apparatus having two charging sleeves was used as the charging apparatus 2. However, the present invention is also applicable to a charging apparatus, such as the one shown in FIG. 7, which has only a single charging sleeve, just as effectively as it is to a charging apparatus having two charging sleeves; the application can control the amount by which the magnetic particles 135 adhere to the photosensitive drum 1, just as effectively as it does when it is applied to a charging apparatus like the charging apparatus in this embodiment having two charging sleeves.

Embodiment 6

The charging apparatus 2 in this embodiment is different in the insulated portions of the regulating blade 137 from the charging apparatus in the fifth embodiment.

The charging apparatus 2 in this embodiment is the same in structure as the charging apparatus in the fifth embodiment, except that the regulating blade 137 in this embodiment is coated with an insulative substance only across the lengthwise end portion (second insulated portions).

Figure 13:
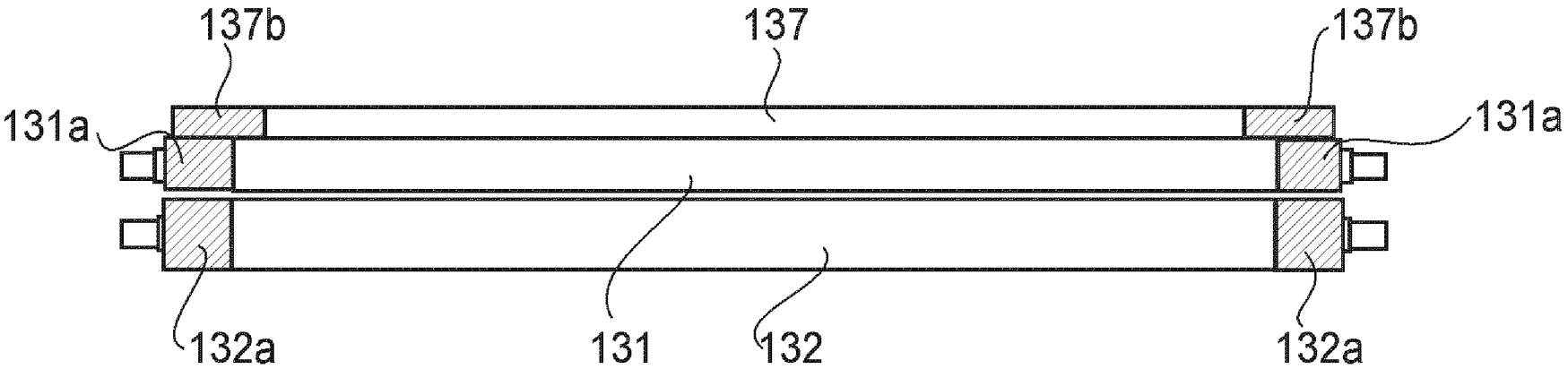
FIG. 13 is a plan view of the charging apparatus in the sixth embodiment of the present invention, showing the relationship among the first charging sleeve, second charging sleeve, and regulating blade of the charging apparatus.

FIG. 13 is a plan view of the charging apparatus in this embodiment, showing the relationship among the first charging sleeve 131, second charging sleeve 132, and regulating blade 137 of the charging apparatus 2.

The charging apparatus 2 in this embodiment employs a SUS blade whose surface is coated with PI (polyimide) only across its lengthwise end portions, as the regulating blade 137. In terms of the lengthwise direction of the regulating blade 137, each of the lengthwise end portions 137*b*, which is the portion coated with PI, extends from a point within the range corresponding to the magnetic particle bearing portion of the sleeve 131 to the corresponding lengthwise end of the regulating blade 137.

Also in the case of the charging apparatus 2 in this embodiment, for the purpose of confirming that the charging apparatus 2 in this embodiment is substantially smaller in the amount by which the magnetic particles 135 adhere to the lengthwise end portions of the photosensitive drum 1 than a conventional charging apparatus, the amount of the magnetic particles 135 having adhered to the lengthwise portions of the photosensitive drum 1 was measured with the use of the same method as the one used to measure the amount of the magnetic particles 135 which adhered to the photosensitive drum 1 in the first embodiment.

In the case of the charging apparatus 2 in this embodiment, 17.5 mg of magnetic particles 135 were captured by the magnets 151. It is evident from this result that the employment of the charging apparatus 2 in this embodiment substantially reduces the amount by which magnetic particles 135 adhere to the lengthwise end portions of the photosensitive drum 1, compared to the employment of a conventional charging apparatus.

In the case of the charging apparatus 2 in this embodiment, electric charge flows into the regulating blade 137 through the magnetic particles 135 on the portion of the magnetic particle bearing portion of the peripheral surface of the sleeve 131, which is in the charging range. This electric charge increases the regulating blade 137 in potential. However, the lengthwise end portions 137*b* of the regulating blade 137 are insulated. Therefore, it does not occur that electric charge flows into the magnetic particles 135 through the lengthwise end portions 137*b* (insulated portions) of the regulating blade 137. Therefore, the charging apparatus 2 in this embodiment is substantially smaller in the amount by which the magnetic particles 135 adhere to the lengthwise end portions of the photosensitive drum 1 than a conventional charging apparatus.

Further, in this embodiment, only the lengthwise end portions of the regulating blade 137 are insulated; the portion of the regulating blade 137, which corresponds to the portion of the photosensitive drum 1, which is in the image formation range, is not insulated. Therefore, the surface of the regulating blade 137, which regulates the magnetic particles 135 on the portions of the sleeves 131 and 132, which are in the image formation range of the photosensitive drum 1, is more precisely finished. Therefore, the regulating blade 137 in this embodiment can more precisely regulate the amount by which magnetic particles 135 are borne on the sleeves 131 and 132 per unit area.

Incidentally, in this embodiment, a charging apparatus having two charging sleeves was used as the charging apparatus 2. However, the present invention is also applicable to a charging apparatus, such as the one shown in FIG. 7, which has only a single charging sleeve, just as effectively as it is to a charging apparatus having two charging sleeves; the application can control the amount by which the magnetic particles 135 adhere to the photosensitive drum 1, just as effectively as it does when it is applied to a charging apparatus like the charging apparatus in this embodiment having two charging sleeves.

Embodiment 7

In this embodiment, a charging apparatus is provided with the same conductive member as the conductive member 157 employed in the fifth embodiment. Further, the conductive member 157 is grounded. That is, the charging apparatus 2 in this embodiment has the conductive member 157 employed in the first embodiment, and the regulating blade 137 employed in the fifth embodiment.

The employment of the insulated regulating blade 137 can eliminate the problem that electric charge moves to the magnetic particles on the lengthwise end portions of the charging sleeve through the regulating blade. Further, the conductive member 157 is grounded. Therefore, even if electric charge moves to the magnetic particles on the lengthwise end portions of the charging sleeve, the electric charge escapes out of the apparatus through the conductive member. These effects prevent the adhesion of the magnetic particles to the lengthwise end portions of the photosensitive drum 1.

Also in the case of the charging apparatus 2 in this embodiment, for the purpose of confirming that the charging apparatus 2 in this embodiment is substantially smaller in the amount by which the magnetic particles 135 adhere to the lengthwise end portions of the photosensitive drum 1 than a conventional charging apparatus, the amount of the magnetic particles 135 having adhered to the lengthwise portions of the photosensitive drum 1 was measured with the use of the same method as the one used to measure the amount of the magnetic particles 135 which adhered to the photosensitive drum 1 in the first embodiment.

In the case of the charging apparatus 2 in this embodiment, 1.0 mg of magnetic particles 135 was captured by the magnets 151. It is evident from this result that the employment of the charging apparatus 2 in this embodiment substantially reduces the amount by which magnetic particles 135 adhere to the lengthwise end portions of the photosensitive drum 1, than the employment of a conventional charging apparatus. Further, the employment of both the conductive member 157 employed in the first embodiment and the regulating blade 137 employed in the fifth embodiment makes it possible to more effectively control the adhesion of the magnetic particles.

Incidentally, the regulating blade 137 in this embodiment may be replaced with a regulating blade, such as the one in the sixth embodiment, which is insulated only across its lengthwise end portions. The replacement does not affect the effectiveness of the charging apparatus in this embodiment.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 227657/2006 and 203240/2007 filed Aug. 24, 2006 and Aug. 3, 2007, respectively which are hereby incorporated by reference.

What is claimed is:

1. A charging apparatus for charging a member to be charged by contacting magnetic particles to the member to be charged, said charging apparatus comprising:

a magnetic particle carrying member for magnetically carrying the magnetic particles, said magnetic particle carrying member being rotatable, wherein said magnetic particle carrying member is provided at a longitudinal end portion of said magnetic particle carrying member with an insulated portion electrically insulated from the magnetic particles carried by said magnetic particle carrying member; and an electroconductive member disposed for contacting the magnetic particles carried on said insulated portion, wherein said electroconductive member is non-rotatable when said magnetic particle carrying member rotates, and wherein an absolute value of a potential of said electroconductive member is lower than an absolute value of a voltage applied to said magnetic particle carrying member.

2. An apparatus according to claim 1, wherein the absolute value of the potential of said electroconductive member is not more than 100 V.

3. An apparatus according to claim 1, wherein said electroconductive member is electrically grounded.

4. An apparatus according to claim 1, wherein said electroconductive member is made of magnetic material.

5. An apparatus according to claim 1, wherein said electroconductive member contacts said magnetic particles within a range of said insulated portion with respect to a longitudinal direction of said magnetic particle carrying member.

6. An apparatus according to claim 1, wherein said electroconductive member is provided at a boundary portion between a region where the magnetic particles are carried on said magnetic particle carrying member and a region where the magnetic particles are not carried on said magnetic particle carrying member.

7. A charging apparatus for charging a member to be charged by contacting magnetic particles to the member to be charged, said charging apparatus comprising:

a magnetic particle carrying member for magnetically carrying the magnetic particles; and a magnetic particle regulating member for regulating an amount of the magnetic particles carried on said magnetic particle carrying member, wherein said magnetic particle carrying member is provided at a longitudinal end portion of said magnetic particle carrying member with a first insulated portion electrically insulated from the magnetic particles carried by said magnetic particle carrying member, and wherein said magnetic particle regulating member is provided at a portion opposing said first insulated portion with a second insulated portion insulated from the magnetic particles, and wherein, at the portion opposing said first insulating portion, regulation of the amount of the magnetic particles carried on said magnetic particle carrying member is performed only by said second insulated portion of said magnetic particle regulating member.

8. An apparatus according to claim 7, wherein said magnetic particle carrying member has a magnetic particle carrying region for magnetically carrying the magnetic particles, and said second insulated portion extends from inside of said magnetic particle carrying region to outside of said magnetic particle carrying region.

9. An apparatus according to claim 7, wherein said second insulated portion extends over an entire area of said magnetic particle regulating member with respect to a longitudinal direction of said magnetic particle carrying region.

10. An apparatus according to claim 7, wherein said magnetic particle regulating member is made of an insulative material.

11. An apparatus according to claim 7, further comprising an electroconductive member disposed so as to contact the magnetic particles carried on said first insulated portion, wherein an absolute value of a potential of said electroconductive member is lower than an absolute value of a voltage applied to said magnetic particle carrying member.

12. An apparatus according to claim 11, wherein the absolute value of the potential of said electroconductive member is not more than 100 V.

13. An apparatus according to claim 11, wherein said electroconductive member is electrically grounded.

14. An apparatus according to claim 11, wherein said electroconductive member is made of magnetic material.

15. An apparatus according to claim 11, wherein said electroconductive member contacts said magnetic particles within a range of said insulated portion with respect to a longitudinal direction of said magnetic particle carrying member.

16. An apparatus according to claim 11, wherein said electroconductive member is provided at a boundary portion between a region where the magnetic particles are carried on said magnetic particle carrying member and a region where the magnetic particles are not carried on said magnetic particle carrying region.

17. An image forming apparatus comprising:

an image bearing member which is a member to be charged; and a charging apparatus for charging the member to be charged by contacting magnetic particles to the member to be charged, said charging apparatus including:

a magnetic particle carrying member for magnetically carrying the magnetic particles and for being supplied with a voltage, said magnetic particle carrying member being rotatable, wherein said magnetic particle carrying member is provided at a longitudinal end portion of said magnetic particle carrying member with an insulated portion electrically insulated from the magnetic particles carried by said magnetic particle carrying member; and an electroconductive member for contacting the magnetic particles carried on said insulated portion, wherein said electroconductive member is non-rotatable when said magnetic particle carrying member rotates, and wherein an absolute value of a potential of said electroconductive member is lower than an absolute value of a voltage applied to said magnetic particle carrying member.

18. An apparatus according to claim 17, wherein said image bearing member is an electrophotographic photosensitive member made of amorphous silicon material.

19. An image forming apparatus comprising:

an image bearing member which is a member to be charged; and a charging apparatus for charging the member to be charged by contacting magnetic particles to the member to be charged, said charging apparatus including:

a magnetic particle carrying member for magnetically carrying the magnetic particles; and a magnetic particle regulating member for regulating an amount of the magnetic particles carried on said magnetic particle carrying member, wherein said magnetic particle carrying member is provided at a longitudinal end portion of said magnetic particle carrying member with a first insulated portion electrically insulated from the magnetic particles carried by said magnetic particle carrying member, and wherein said magnetic particle regulating member is provided at a portion opposing said first insulated portion with a second insulated portion insulated from the magnetic particles, and wherein, at the portion opposing said first insulating portion, regulation of the amount of the magnetic particles carried on said magnetic particle carrying member is performed only by said second insulated portion of said magnetic particle regulating member.

20. An apparatus according to claim 19, wherein said image bearing member is an electrophotographic photosensitive member made of amorphous silicon material.

* * * * *